US006915868B1

(12) United States Patent
Mosing et al.

(10) Patent No.: US 6,915,868 B1
(45) Date of Patent: Jul. 12, 2005

(54) ELEVATOR APPARATUS AND METHOD FOR RUNNING WELL BORE TUBING

(75) Inventors: Donald E. Mosing, Lafayette, LA (US); David L. Sipos, Youngsville, LA (US)

(73) Assignee: Frank's Casing Crew and Rental Tools, Inc., Lafayette, LA (US)

( * ) Notice: Subject to any disclaimer, the term of this patent is extended or adjusted under 35 U.S.C. 154(b) by 0 days.

(21) Appl. No.: 09/723,865

(22) Filed: Nov. 28, 2000

(51) Int. Cl.[7] ..... E21B 19/06; E21B 19/07; E21B 19/10

(52) U.S. Cl. ..... 175/423; 166/77.4; 166/77.52; 166/380; 294/86.31; 294/91; 294/102.2

(58) Field of Search ..... 166/378, 379, 166/386, 381, 383, 77.1, 77.11, 77.51, 77.52; 175/52, 85, 423; 294/86.1, 86.26, 86.3, 86.31, 294/88, 90, 91, 102.1, 102.2, 103.1

(56) References Cited

U.S. PATENT DOCUMENTS

| | | | | | |
|---|---|---|---|---|---|
| 1,417,490 | A | * | 5/1922 | Brandon | 166/77.51 |
| 1,637,200 | A | * | 7/1927 | O'Brien | 175/423 |
| 2,260,876 | A | * | 10/1941 | Wagner | 175/423 |
| 2,269,888 | A | * | 1/1942 | Sharp | 175/423 |
| 2,545,627 | A | * | 3/1951 | Moore | 173/166 |
| 2,612,671 | A | * | 10/1952 | Martin | 188/67 |
| 3,149,391 | A | * | 9/1964 | Boter | 294/102.2 |
| 3,495,864 | A | * | 2/1970 | Jones et al. | 294/113 |
| 3,588,162 | A | * | 6/1971 | Jones et al. | 294/90 |
| 3,683,466 | A | * | 8/1972 | Hughes | 384/24 |
| 3,776,320 | A | * | 12/1973 | Brown | 173/213 |
| 4,126,348 | A | * | 11/1978 | Palmer | 294/88 |
| RE29,995 | E | * | 5/1979 | Guier | 294/90 |
| 4,253,219 | A | * | 3/1981 | Krasnov | 294/102.2 |
| 4,361,940 | A | * | 12/1982 | McFadden | 175/423 |
| 4,381,584 | A | * | 5/1983 | Coyle, Sr. | 166/97.5 |
| 4,413,387 | A | * | 11/1983 | Guier | 188/67 |
| 4,475,607 | A | * | 10/1984 | Haney | 188/67 |
| 4,511,168 | A | * | 4/1985 | Haynes | 294/102.2 |
| 4,550,942 | A | * | 11/1985 | Berg | 294/102.2 |
| 4,821,814 | A | * | 4/1989 | Willis et al. | 173/164 |
| 4,843,945 | A | * | 7/1989 | Dinsdale | 81/57.34 |
| 4,867,236 | A | * | 9/1989 | Haney et al. | 166/77.51 |
| 5,042,601 | A | * | 8/1991 | Penisson | 166/96.1 |
| 5,609,226 | A | * | 3/1997 | Penisson | 188/67 |
| 6,330,918 | B1 | * | 12/2001 | Hosie et al. | 166/341 |
| 6,450,385 | B1 | * | 9/2002 | Guerin | 226/89 |
| 2002/0189804 | A1 | * | 12/2002 | Liess et al. | 166/77.51 |

* cited by examiner

*Primary Examiner*—David Bagnell
*Assistant Examiner*—Jennifer H Gay
(74) *Attorney, Agent, or Firm*—The Matthews Firm

(57) ABSTRACT

An elevator apparatus for manipulating well bore tubing includes a circular body having a top and a central cavity around a body axis. The cavity has a diameter allowing the collar portion of the tubing to pass longitudinally therethrough. A plurality of cavity restricting members above the body, supported on and spaced apart around the top of the body, have proximal and distal portions in respect to the cavity. One or more actuators are operatively associated with the petal plates for moving the proximal portion of each cavity restricting member into the cavity an extent sufficient, in combination with the other cavity restricting members so moved, to prevent passage of the collar portion of the tubing through the cavity, thereby to hold the tubing with the elevator.

6 Claims, 25 Drawing Sheets

ELEVATOR APPARATUS AND METHOD FOR RUNNING WELL BORE TUBING

FIELD OF THE INVENTION

This invention relates generally to methods and apparatus for installing and removing well bore tubing, and more particularly to tools used to hold and lower drill pipe or casing into a well bore.

BACKGROUND OF THE INVENTION

Elevators and/or spiders are essentially functionally identical gripping devices used cooperatively to hold and lower drill pipe or tubular well casing into a well bore. These tools have varied over the years, but their essential overall design and function has remained the same. Elevator and spider slip assemblies conventionally have hinged arms that latch at the unhinged ends. With arms apart, they are placed around a given section of the tubing in a tubing string, then the arms are hinged closed and latched, forming a housing surrounding the tubing. The housing is commonly referred to as a "bowl". The bowl contains a plurality of slips surrounding the tubing. The radial interior surface of the slips typically form or carry hard metal teeth for gripping the tubing. The exterior surface of the slips and interior surface of the bowl usually have opposing complementary engagement surfaces which are inclined radially inward and downwardly. The complementary surfaces between the slips and bowl serve to inject the slip and gripping elements in a longitudinal and radial direction in relation to the tubing for engagement or disengagement of the tubing. Thus, when an elevator or slip is engaged about a tubing and the weight of the tubing in the tubing string is lowered into the elevator or slip, the tubing engages the gripping elements on the slips, causing them to move downward in relation to the bowl and radially inward in a "self-tightening" securing of the tubing.

During traditional well-boring operations, a spider is located near the rotary table and is used for securing tubing in the well. An elevator is suspended from the rig hook, which is used for running or retrieving the tubing string. In a typical operation, the spider remains stationary to fix the tubing, while the elevator is lowered and placed around the tubing and engages the tubing by "self tightening". The spider then disengages from the tubing when the slips are radially removed away from the tubing string, allowing the elevator to move the tubing string relative to the rotary table as needed. The spider then re-engages the tubing, allowing the elevator to continue running or removing the tubing string.

A problem associated with the use of these tools is related to gripping the drill pipe or casing collar which is of a larger diameter than the outside diameter of the body of the tubing. The problem is caused when the elevator slip assembly is not lowered sufficiently below the collar (including, in the case of drill pipe, the portion of the pipe transitioning from the exterior of the well casing below the collar to the maximum exterior diameter of the collar, sometimes called the "upset"). The slip assemblies are designed such that the gripping forces generated are sufficient for proper gripping only when the slips are lowered far enough below a casing collar to completely grip the outside diameter of the well casing and not the collar. When the collar is gripped, the slips will not engage with the casing sufficiently to generate adequate gripping forces. The result is that partial engagement of the slips against the casing string may result in the casing slipping from the tool and dropping into the well bore causing significant down time and repair.

Further, with the advent of tubing of high chromium content, the surface damage caused by slips has become undesirable because it can lead to unacceptable stress concentrations and stress corrosion in sour well conditions. There is therefore a need for an elevator apparatus and method of operation that can hold and manipulate tubing without significantly damaging the surface of the tubing and that eliminates the risk in traditional systems of engaging the tubing collar with resultant loss of "grip".

SUMMARY OF THE INVENTION

Breaking with the conventional slip elevators of the past, this invention provides a new kind of elevator for manipulating elongate tubular goods having a collar portion that are placed in a well bore, e.g., casing tubing and drill pipe. All tubing or pipe that is run into a well bore hereinafter is called "tubing" or "tube" without distinction whether it is casing, drill pipe or other well bore tubing; all well bore tubing is comprehended. The "collar portion" of tubing means the collar proper as well as any "upset" as that term is described hereinabove.

Overall Invention

This new kind of elevator overall comprises:

(A) a circular body having a top and a central cavity around a body axis, the cavity having a diameter allowing the collar portion of tubing to pass longitudinally therethrough, (B) a plurality of cavity restricting members above the body supported on and spaced apart around the top of the body and having proximal and distal portions in respect to the cavity, and (C) one or more actuators operatively associated with the petal plates, for moving the proximal portion of each cavity restricting member into the cavity an extent sufficient, in combination with the other cavity restricting members so moved, to prevent passage of the collar portion of the tubing through the cavity, thereby to hold the tubing with the elevator.

The one or more actuators preferably also operate to retract the proximal portions of the cavity restricting members out of the cavity, to allow the collar portion of the tubing to pass through the cavity.

The new apparatus of this invention carries out a new method of manipulating well bore tubing having a collar, overall comprising:

(A) introducing the tubing into the cavity of a circular body having a central cavity of diameter to admit therethrough a collar portion of the tubing, (B) positioning said body below the collar portion of the tubing, and (C) moving the proximal portions of a plurality of cavity restricting members supported on and spaced apart around the top of the body and having proximal and distal portions in respect to the cavity, into the cavity an extent sufficient to prevent passage of the collar portion of the tubing through the cavity.

The method of preferably further comprised retracting the proximal portions of the cavity restricting members out of the cavity, to allow the collar portion of the tubing to pass through the cavity.

A number of forms of embodying the overall invention are provided, each with different forms of the cavity restricting members and different means of moving the proximal portions of the different forms of cavity restricting members into the cavity. Within each basic subset of forms of the cavity restricting members, there are variations of the form and variations of the means of moving the forms.

For purposes of clarity, the overall invention directed to the cavity restricting members is illustrated by a detailed description of the numerous forms of the invention. These are set forth in categories as "Basic Form I of the Invention", "Basic Form II of the Invention" and "Basic Form III of the Invention."

Basic Form I of the Invention

Basic Form I of the invention comprises: (a) a circular body having a top and a central cavity of diameter allowing the collar portion of the tubing to pass longitudinally therethrough, that is, to pass the entire width of the tubing including the collar portion, and (b) a plurality of "petal" plates having radially inner and outer portions horizontally supported on and spaced apart around the top of the body, and (c) one or more actuators operatively associated with the petal plates, for extending each petal plate radially inward, substantially normal to the axis of the body cavity, over the body into the cavity an extent sufficient, in combination with the other petal plates so extended, to prevent passage of the collar portion of the tubing through the cavity, that is, to allow longitudinal passage through the cavity of the width of the tubing except the collar portion, thereby to hold the tubing in the elevator. Preferably, also, the one or more actuators operate to retract the petal plates over the body radially out of the cavity, to allow the collar portion of the tubing to pass through the cavity.

The plates are called "petal" plates because in their orientation to the cavity, these plates vaguely suggest the petals of a flower horizontally arranged about the center of the flower. The word "petal" is not used in a literally descriptive or restrictive sense.

With the petal plates extended, the petal plates hold the collar portion of the well bore tubing in the elevator and thereby support the entire weight of the well bore tubing in the elevator body. When the weight of a well bore tube is on the petal plates, the elevator body that supports the plates is a fulcrum to the petal plates, and the petal plates are a lever to the fulcrum. To oppose the lever force on the portion of the petal plates radially outward from the elevator body caused by the weight of the tubing on the portion of the petal plates inside the cavity when the petal plates are extended, the elevator preferably includes a counterforce member in operative arrangement with the petal plates. The counterforce member suitably is a circular or annular member surrounding the cavity, spaced radially outwardly from the body and located above and adjacent the outer portion of the petal plates when they are in the extended position. Advantageously the circular member is secured by one or more buttresses fixed relative to the body below the petal plates. Suitably a plurality of buttresses are interposed between the spaced apart petal plates.

In one form of the elevator of Basic Form I of the invention, the actuator comprises a cam and the plate is a cam follower. The petal plates include an aperture receiving a cam comprising an eccentric lobe and a camshaft located radially outward from said body, rotatable about an axis substantially parallel to the axis of the cavity. Rotating the cam eccentric pushes the petal plate proximal portion in or out of the body cavity. In another form, the cam is elongate, is located radially outward from the circular elevator body, and is linearly movable parallel to the axis of the elevator cavity. The cam suitably is received in an aperture in the petal plate between the inner and outer portions of the petal plate. Advantageously the cam is moved linearly parallel to the axis of the cavity by the action of a rod of a piston in a cylinder and piston assembly. The cylinder is fixed relative to the body, and the piston rod attaches to the cam at the rod end distal from the piston. The rod is moved by force of fluid admitted into or withdrawn from a cylinder within which the piston reciprocates. Alternatively, the cam is moved linearly parallel to the axis of the cavity by translation to vertical motion of rotary motion applied by rotating a ring cam surrounding the cavity. For this the elongate cam suitably includes a portion above the elevation of the body when the petal plates are retracted, and a ring is located adjacent the cam portion between such cam portion and the cavity over the body. One of the cam portion and the ring contains a helical groove facing the other and the other contains a pin facing the helical groove, whereby, upon rotation of the ring in one rotational direction about the cavity axis, the pin follows the groove and moves the elongate cam in one linear direction parallel to the axis, and upon rotation of the ring in a rotational direction about the cavity axis opposite to the one direction, the pin follows the groove and moves the elongate cam parallel to the axis in a linear direction opposite to the one linear direction. Where the helical groove is formed in the elongate cam, the ring cam moves a pin in the helical groove, elevating the elongate cam when the pin is caused by ring cam rotation to move upward in the groove, and lowering the cam when the pin is caused by ring cam rotation to move downward in the groove.

In another form of Basic Form I of the invention involving the elongate cam wherein the cam includes a portion above the elevation of the body when the petal plates are retracted, that portion has a recess facing the cavity, and an annular reciprocation piece is received in such recess. The reciprocation piece upon reciprocation moves the cam linearly parallel to the cavity axis.

In another form of Basic Form I of the invention, the actuator comprises a link affixed to the plate. The link may be a slide that reciprocates radially inwardly and outwardly in a channel substantially normal to the axis of the cavity. Suitably the slide is reciprocated by the action of a rod of a piston moved by force of fluid admitted into or withdrawn from a cylinder within which the piston reciprocates, the cylinder being fixed relative to the body and the piston rod end distal from the piston attaching the slide.

Alternatively, the link may be a pivot member that pivots upwardly toward the cavity and downwardly away from the cavity on a pivot axis that is transverse to the axis of the cavity and is located radially outwardly of the body, for moving a petal plate radially inwardly or outwardly on pivoting the pivot member upwardly or downwardly, respectively. In this latter form, suitably, a sleeve surrounds the link, the body and the petal plates. The sleeve is linearly moveable parallel to the axis of the cavity. The link includes a finger that is remote from the link pivot axis and is received within a capture located on the interior of the sleeve, whereby, on upward movement of the sleeve, the link pivots upwardly to move a petal plate radially inwardly partially into the cavity, and upon downward movement of the sleeve, the link pivots downwardly to move the petal plate out of the cavity. Suitably the sleeve is moved by the action of a rod of a piston moved by force of fluid admitted into or withdrawn from a cylinder within which the piston reciprocates, the cylinder being fixed relative to the body and the piston rod end distal from the piston attaching the sleeve.

The apparatus of this invention embodies forms with which to perform a method which comprises this invention. In accordance with this invention, a method of manipulating well bore tubing comprises (a) introducing the tubing into the cavity of a circular body having a central cavity of diameter to admit therethrough the entire width of the tubing including the collar portion, (b) positioning the body below the collar portion of the tubing, and (c) moving a plurality of spaced apart petal plates horizontally supported on and spaced apart over the top of the body, radially inward, substantially normal to the body axis, over the body, into the cavity, to an extent sufficient to prevent passage of the collar portion of he tubing through the cavity.

In the form of Basic Form I of the invention in which the petal plates include an aperture receiving an elongate cam movable linearly parallel to the axis of the cavity for sliding on the plate, the above described step of moving the petal plates comprises actuating the cam to ride the plate onto the cam. The slider cam is suitably actuated by a rod of a piston moved by force of fluid admitted into or withdrawn from a cylinder within which the piston reciprocates, the cylinder being fixed relative to the body and the piston rod end distal from the piston attaching the cam. Alternatively, the slider cam is actuated by rotating a ring cam surrounding the cavity and operatively connected to the slider cam to translate the rotary motion of the ring cam to linear motion of the slider cam, as above described.

In the form of Basic Form I of the invention in which the petal plates are connected to a slide that reciprocates radially inward and outward substantially normal to the axis of the cavity, the above described step of moving the petal plates comprises moving the slide radially inward. The slide suitably is moveable by a rod of a piston moved by force of fluid admitted into or withdrawn from a cylinder within which the piston reciprocates, the cylinder being fixed relative to the body and the piston rod end distal from the piston attaching the slide.

In the form of Basic Form I of the invention in which the petal plates are connected to a link that pivots on an axis transverse to the axis of the cavity, the above described step of moving the petal plates comprises pivoting the link upwardly. Suitably the link is pivoted upwardly by a rod of a piston moved by force of fluid admitted into or withdrawn from a cylinder within which the piston reciprocates, the cylinder being fixed relative to the body and the piston rod end distal from the piston attaching the link distal from the link pivot.

In the form of Basic Form I of the invention in which the petal plates are connected to a link that includes a finger received within a capture located on the interior of a sleeve surrounding the body and that is slidable parallel to the axis of the cavity, the above described step of moving the petal plates comprises sliding the sleeve upwardly. Suitably, the sleeve is slid upwardly by the action of a rod of a piston moved by force of fluid admitted into or withdrawn from a cylinder within which the piston reciprocates, the cylinder being fixed relative to the body, the piston rod end distal from the piston attaching the sleeve.

Basic Form II of the Invention

The elevator apparatus of Basic Form II of this invention comprises (a) an annular body having a central cavity around a body axis, the cavity having a diameter allowing the collar portion of tubing to pass longitudinally therethrough, (b) a plurality of pivotal arm members spaced apart around the body, and (c) one or more actuators operatively associated with the arm members. The term "cavity" as used herein means an opening or passage through the body and a projection of the cavity adjacent the body.

The plurality of arm members spaced apart around the body are pivotable at one end, around an arm member axis parallel to the body axis, from a first position where portions of the arm members proximal to the cavity are not within the body cavity, to a second position where the proximal portions of the arm members are inside the cavity. The one or more actuators operatively associated with the arm members pivot each arm member about its arm member axis to reversibly move the arm members from said first position, where the collar portion of said tubing can pass through the cavity, to said second position, where the collar portion of the tubing is prevented by the proximal portions of the arm members from passing through the cavity.

In one form of the invention, the plurality of arm members comprises a plurality of arm member pairs, each arm member of a pair having front and rear portions. The front portion of one arm member of the pair opposes the front portion the other arm member of the pair. One arm member of a pair pivots clockwise, and the other arm member of the pair pivots counterclockwise. This swings the arm members from a first or un-deployed position where the front portions of the arm members are removed from one another and the proximal portions of the arm members are not within a projection of the body cavity, to a second or deployed position where the front portions of the arm members of a pair are adjacent one another and the proximal portions of the arm member pair are inside a projection of the cavity.

In another form of the invention, all arm members pivot in the same direction to swing the arm members from a first or un-deployed position where the proximal portions of the arm members are not within the body cavity, to a second or deployed position where the proximal portions of the arm member pair are inside a projection of the cavity.

The apparatus forms of the invention perform a method of the invention for manipulating well bore tubing having a collar portion. The method comprises introducing the tubing into the cavity of a circular body having a central cavity of diameter to admit therethrough a collar portion of the tubing, positioning said body below the collar portion of the tubing, and pivoting a plurality of arm members around an arm member axis parallel to the body axis, from a first or un-deployed position where portions of the arm members proximal to the cavity are not within the body cavity, to a second or deployed position where the proximal portions of the arm members are sufficiently inside the cavity that the collar portion but not the remainder of the tubing is prevented by the proximal portions of the arm members from passing through the cavity.

In accordance with a particular of the method, the plurality of arm members comprises a plurality of arm member pairs. Each arm member of a pair has front and rear portions. The front portion of one arm member of the pair opposes the front portion the other arm member of the pair. The step of pivoting a plurality of said arm members comprises pivoting one arm member of each pair of arm members clockwise and pivoting the other arm member of the pair counterclockwise.

In accordance with another particular of the method, the step of pivoting a plurality of said arm members further comprised pivoting all arm members in the same rotational direction.

Basic Form III of the Invention

In accordance with Basic Form III of the invention, a new elevator apparatus for manipulating well bore tubing having a tubular body terminating in a collar portion, comprises an annular body having an annular top and a central cavity around a body axis, the annular top and the cavity each having a radius allowing the collar portion of the tubing to pass longitudinally therethrough. A plurality of flap plates are spaced apart from the other around the cavity. Each flap plate has radially proximal and distal portions relative to the cavity. The distal portion of each flap plate is pivotally connected to the annular body top. The proximal portion of each flap plate rests on the annular body top and extends into the cavity an extent, which, in combination with the other flap plates, is sufficient to permit passage of the tubing body through the cavity while preventing passage of the collar portion of the tubing. One or more actuators are operatively associated with the flap plates for pivotally lifting the proximal portions of the flap plates out of the cavity, thereby to permit the tubing including the collar portion to pass longitudinally through the cavity.

Advantageously the flap plates are linked to an annular cap plate coaxial with the body axis. The cap plate has a peripheral skirt terminating in a rim, and the rim rests on the body top when the flap plates extend into the cavity. The actuators suitably comprise one or more cylinder and piston assemblies in which a cylinder is fixed relative to the body and a rod connected to the piston engages the cap plate. On actuation, the piston moves in the cylinder to extend the rod relative to the cylinder, and the extension of the rod elevates the cap plate. The elevation of the cap plate pivotally lifts the proximal portions of the linked flap plates out of the body cavity. On retraction of the rod as the piston moves in then opposite direction in the cylinder, the rod lowers, lowering the cap plate, thereby pivotally lowering the linked flap plates into the cavity. A sleeve suitably is affixed to the body surrounding the skirt to prevent foreign objects, especially human fingers, from access to and getting caught in the mechanisms for the flap plate lift and lowering operations.

The proximal portion of the flap plates ends in an arc of radius and length effective to combine with like ends of the other such flap plates, similarly disposed, to form a broken circle of smaller radius than the cavity, of larger diameter than the external diameter of a tubular body receivable in the cavity, and of smaller diameter than the exterior diameter of the collar portion of the tubing. The proximal end advantageously terminates in a concave arc of from parallel to acute angle relative to the axis of the cavity, such angle being selected for the type of collar possessed by the tubing to be run into or removed from the well bore, a parallel angle being suitable for casing, and an acute angle being suitable for drill pipe, where the body portion of the pipe transitions to the collar at an "upset" as previously described. Also for drill pipe applications, the flap plate proximal portion advantageously angles downwardly from the level of the more distal portion of the flap plate, to extend into the cavity at an acute angle to the body axis. Suitably this angle is 45 degrees.

The elevator apparatus has a pair of lift arms secured to the body on laterally opposite sides of the body for receipt of bales of a rig draw works for raising and lowering elevator apparatus and tubing captured in the apparatus.

DETAILED DESCRIPTION OF INVENTION

Basic Form I of the Invention

Figure 1:
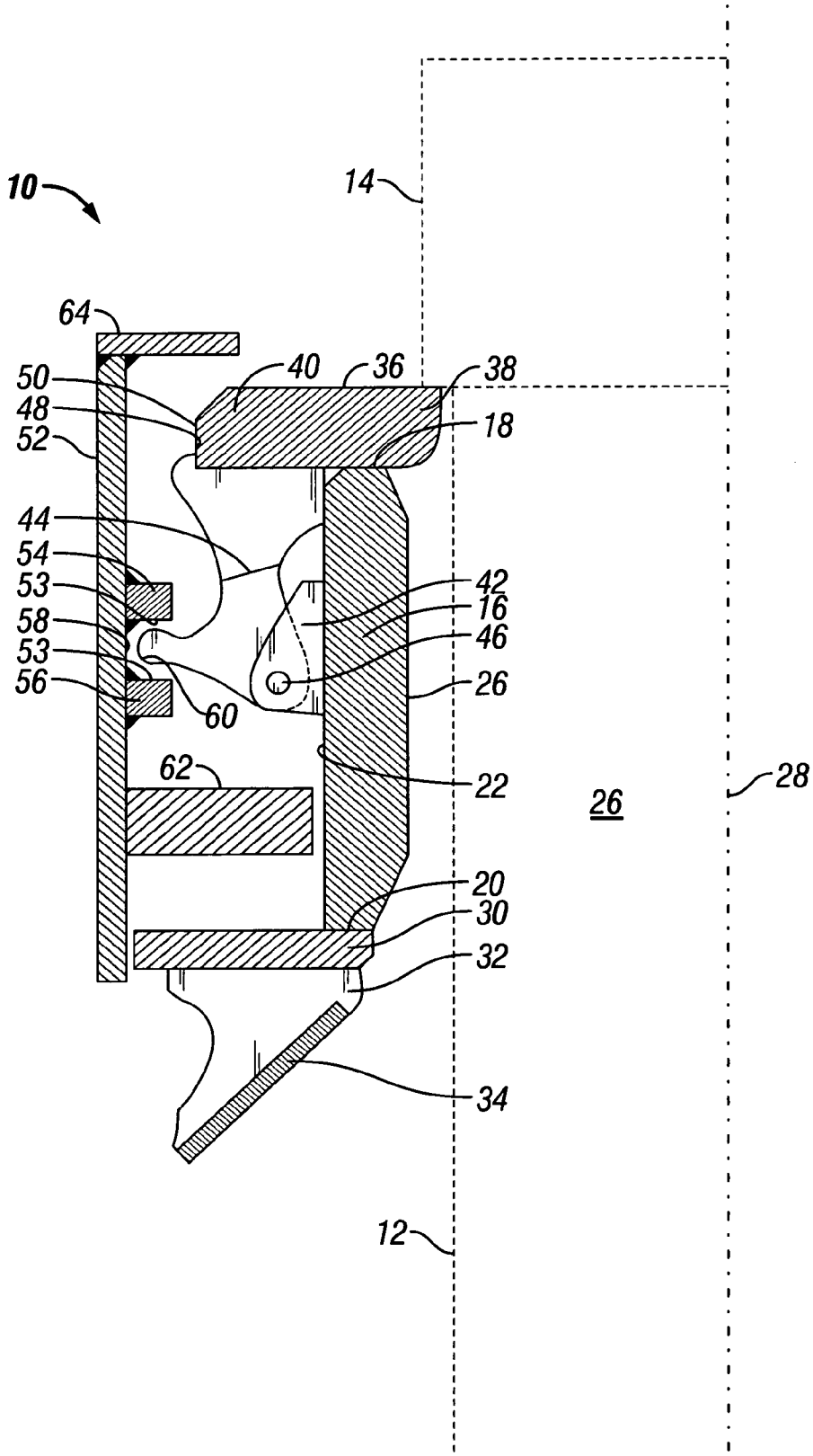
FIG. 1 is a conceptual schematic side view, in partial section of a first form of Basic Form I of the invention.

Referring to FIG. 1, an elevator apparatus for manipulating well bore tubing having a collar is indicated generally by the reference number 10. FIG. 1 and the other figures that follow are conceptual drawings in which the elements of the invention are depicted in their relationship to one another, but in which the shape of the elements is neither the necessary shape nor are the elements presented in necessary scale or proportion in which they might be present in a constructed apparatus making use of the invention. Elements shown in section are annular elements, those not shown in section are as seen from the particular view.

In FIG. 1, a well bore tube shown in shadow outline indicated by reference numeral 12 has a collar portion 14. Apparatus 10 includes an annular body 16 having a top 18, bottom 20, outer side 22, inner side 24 and a central cavity 26. Cavity 26 is centered on body axis 28 and has a diameter sufficient to admit through cavity 26 the entire width of a well bore tube 12, including collar portion 14, that is to be received and manipulated by apparatus 10. The bottom 20 of circular body 16 is affixed to an annular floor plate 30 that surmounts a gusseting plate 32 of a frusto-conical member 34 tapering inwardly toward cavity 26 to guide body 16 over a well bore tube that is to be received within cavity 26.

Horizontally supported on the top 18 of circular body 16 is an annular petal plate 36 that has a radially inner portion 38 and a radially outer portion 40. FIG. 1 shows one of a plurality of petal plates so disposed. The other plates (not shown) are spaced apart around the top 18 of circular body 16.

A flange 42 is affixed to the outer side 22 of body 16 intermediate top 18 and bottom 20 thereof. Flange 42 pivotally mounts a link 44 on a pivot pin 46. Link 44 is notched at 48 to engage the rear 50 of petal plate 36, and has a toothed portion (not seen) that engages a recess in the floor of petal plate 36 intermediate its ends.

A sleeve 52 surrounds circular body 16, petal plate 36 and link 44, and is moveable parallel to cavity axis 28. Welded interiorly to the sleeve 52 are a pair of rings 54, 56 spaced apart to define a capture gap 58. Link 44 has a finger portion 60 that is received in capture gap 58. Also affixed to the interior of sleeve 52 is an annular stop plate 62 that acts as a downstop limiting sleeve homing travel by impinging on floor plate 30 when sleeve 52 is moved parallel to the axis 28 in a direction traveling away from petal plate 36 (a downward movement in the normal condition where the cavity axis 28 is substantially vertical to the horizon). Annular plate 62 also acts as an extension travel limiter when sleeve 52 is moved parallel to the axis 28 in a direction traveling towards petal plate 36, by impingement on flange 42.

Movement of sleeve 52 towards petal plate 36 (normally an upward substantially vertical movement, relative to the horizontal) engages finger portion 60 on the land 55 of ring 56 and pushes finger portion 60 towards petal plate 36, rotating link 44 on pivot pin 46 (clockwise as viewed in FIG. 1), to a maximum degree limited by stop plate 62 impinging on flange 42, and causing link 44 to advance in the direction of cavity axis 28, the notched portion 48 of link 44 acting on the rear 50 of petal plate 36 to push plate 36 radially inwardly towards cavity axis 28 an extent placing the innermost portion 38 of petal plate 36 inside cavity 26 of the body, effective, in combination with the other plates so extended, to allow the entire width of the tube 12 except its collar portion 14 to pass through cavity 26. Movement of sleeve 52 away from petal plate 36 (normally a downward substantially vertical movement, relative to the horizontal) engages finger portion 60 on the land 53 of ring 54 and pushes finger portion 60 away from petal plate 36, rotating link 44 on pivot pin 46 (counterclockwise as viewed in FIG. 1) to a degree limited by stop plate 62 impinging on floor plate 30, causing link 44 to move away from the direction of cavity axis 28, drawing petal plate 36 radially outwardly from cavity axis 28, and in combination with the other petal plates also so drawn radially outwardly, enlarging the cavity to an extent allowing the entire width of tube 12 including the collar portion 14 to escape grasp of apparatus 10.

A circular cap plate 64 welded to the top 51 of sleeve 52 prevents foreign bodies (including appendages of workers) from gaining access to the working parts of elevator apparatus 10.

Suitably sleeve 52 is moved by the action of a rod of a piston moved by force of fluid admitted into or withdrawn from a cylinder within which the piston reciprocates, the cylinder being fixed relative to the body, the piston rod end distal from the piston attaching the sleeve. Such a mover is well know in the art and such mover and the connections of he mover as so described are not illustrated.

In operation of the apparatus shown in FIG. 1, tubing 12 is introduced into cavity of circular body 16 and the body is positioned below the collar portion 14 of he tubing 12. Sleeve 52 is slid upwardly, thereby moving finger portion 60 toward petal plates 36 and pivoting link 44 on pin 46, causing each of a plurality of spaced apart petal plates 36 horizontally supported on top 18 of body 16 to move radially inward to an extent positioning a radially innermost portion 30 of plates 36 within cavity 26 of body 16 sufficiently to prevent passage of collar portion 14 through cavity 26. Then to release the tubing, sleeve 52 is slid downwardly, thereby moving finger portion 60 away from petal plates 36 and pivoting link 44 on pin 46, causing each of a plurality of spaced apart petal plates 36 horizontally supported on top 18 of body 16 to move radially outwardly to an extent removing the innermost portion 38 of plates 36 from cavity 26 of body 16, allowing passage of collar portion 14 through cavity 26.

Figure 2:
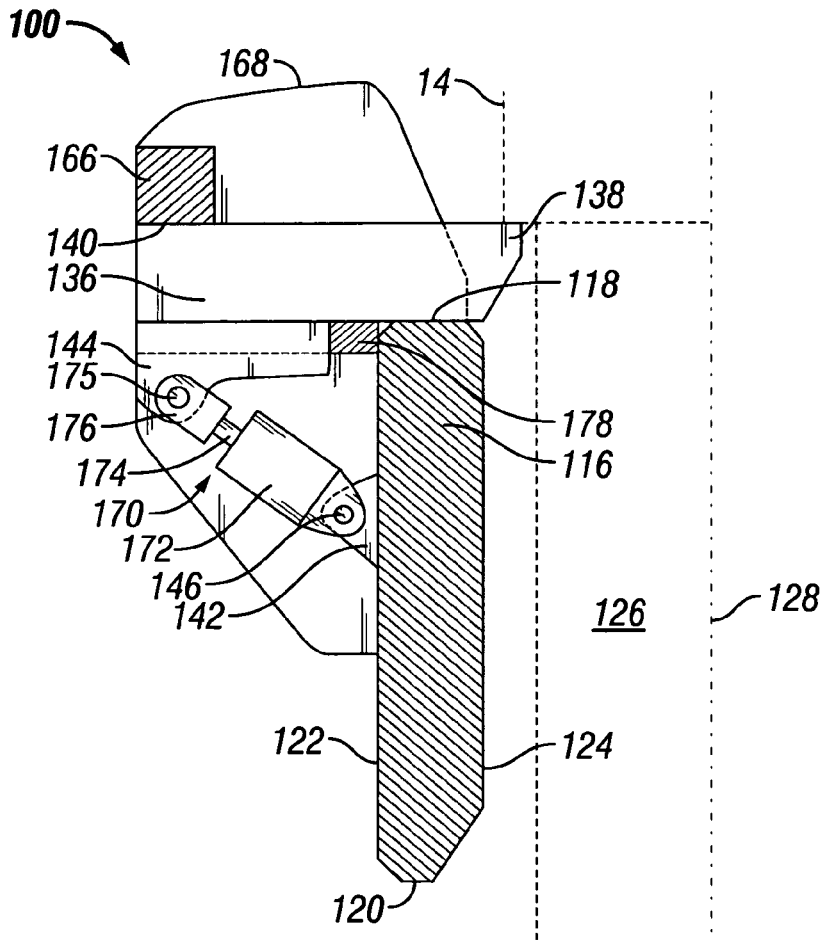
FIG. 2 is a conceptual schematic side view, in partial section of a second form of Basic Form I of the invention.
Figure 3:
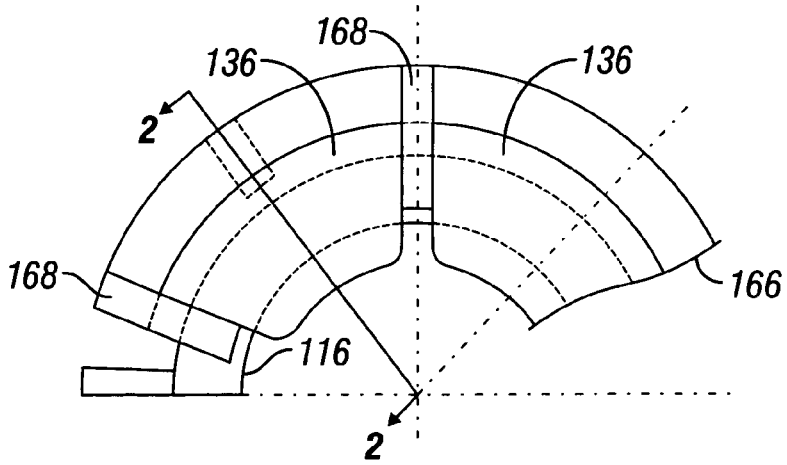
FIG. 3 is a conceptual top view of a portion of the apparatus seen in side sectional view in FIG. 2 along the line 2—2.

Referring now to FIGS. 2 and 3, a second form of an apparatus for manipulating well bore tubing having a collar, in accordance with this invention, is indicated generally by the reference number 100. The same reference numerals as used in FIG. 1 identify well bore tube 12 and collar portion 14. Apparatus 100 includes a circular body 116 having a top 118, bottom 120, outer side 122, inner side 124 and central cavity 126. Cavity 126 is centered on body axis 128 and has a diameter sufficient to admit through cavity 126 the entire width of a well bore tube 12, including collar portion 14, that is to be received for manipulation by apparatus 100. The bottom 120 of circular body 116 may be affixed to an annular floor plate as illustrated in FIG. 1 (not illustrated in FIG. 2).

Horizontally supported on top 118 of circular body 116 is a petal plate 136 that has a radially inner portion 138 and a radially outer portion 140. FIG. 2 shows one of a plurality of petal plates so disposed. The other petal plates are spaced apart around top 118 of circular body 116, as partially shown in the cutaway of FIG. 3. Circular body 116 that supports petal plates 136 is a fulcrum when the weight of a well bore tube 12 is impressed on the innermost portion 138 of the petal plates 136. This occurs when the petals 136, in extended position, as hereinafter described, support the weight of the well bore tube 12. To counter the force moment of such load on petal plates 136, a circular counterforce member or ring 166 surrounds body 116, horizontally spaced radially outward from body 116, and is positioned above and adjacent the top of the outer portion 140 of petal plates 136 including when they are extended into the cavity. Counterforce ring 166 is secured atop pedal plates 136 by a buttress member 168 affixed relative to the body 116 at the outer side 122 and top 118 of body 116. As seen in FIG. 3 in combination with FIG. 2, each buttress 168 is interposed between adjacent spaced petal plates 136.

A flange 142 is affixed to the outer side 122 of body 116 intermediate top 118 and bottom 120 thereof. Flange 142 pivotally mounts the cylinder 172 of a piston and cylinder assembly 170 on a pivot pin 146, pivotally fixing the cylinder relative to the body. Extending from the piston of the cylinder and piston assembly 170 is a rod 174, the end 176 distal to the piston being pivotally mounted on a pin 175 fastened to a link 144 that is affixed to petal plate 136. A slideway substantially normal to axis 128 of cavity 126 is provided for link 144 to slide radially inwardly and outwardly respectively to and from cavity 126 by opposing channel members, one of which, indicated by reference numeral 178, is viewable in FIG. 2. Slide link 144 is reciprocated by the action of rod 174, connected to the piston of cylinder and piston assembly 170 moved by force of fluid admitted into or withdrawn from the cylinder within which the piston reciprocates. On retraction of rod 174, pin 175 moves link 144 radially inward, causing a petal plate 136 among the plurality of such plates horizontally supported on top 118 of body 116 to move radially inward to an extent positioning a radially innermost portion 138 of plates 136 within cavity 126 of body 116 sufficiently to prevent passage of collar portion 14 through cavity 126. To release the tubing, rod 174 is extended from cylinder and piston assembly 170, thereby moving link slide 144 radially away from cavity 126, causing petal plate 136 among the plurality of such plates to move radially outwardly to an extent removing the innermost portion 138 of plates 136 from cavity 126 of body 116, allowing passage of collar portion 14 through cavity 126.

Figure 4:
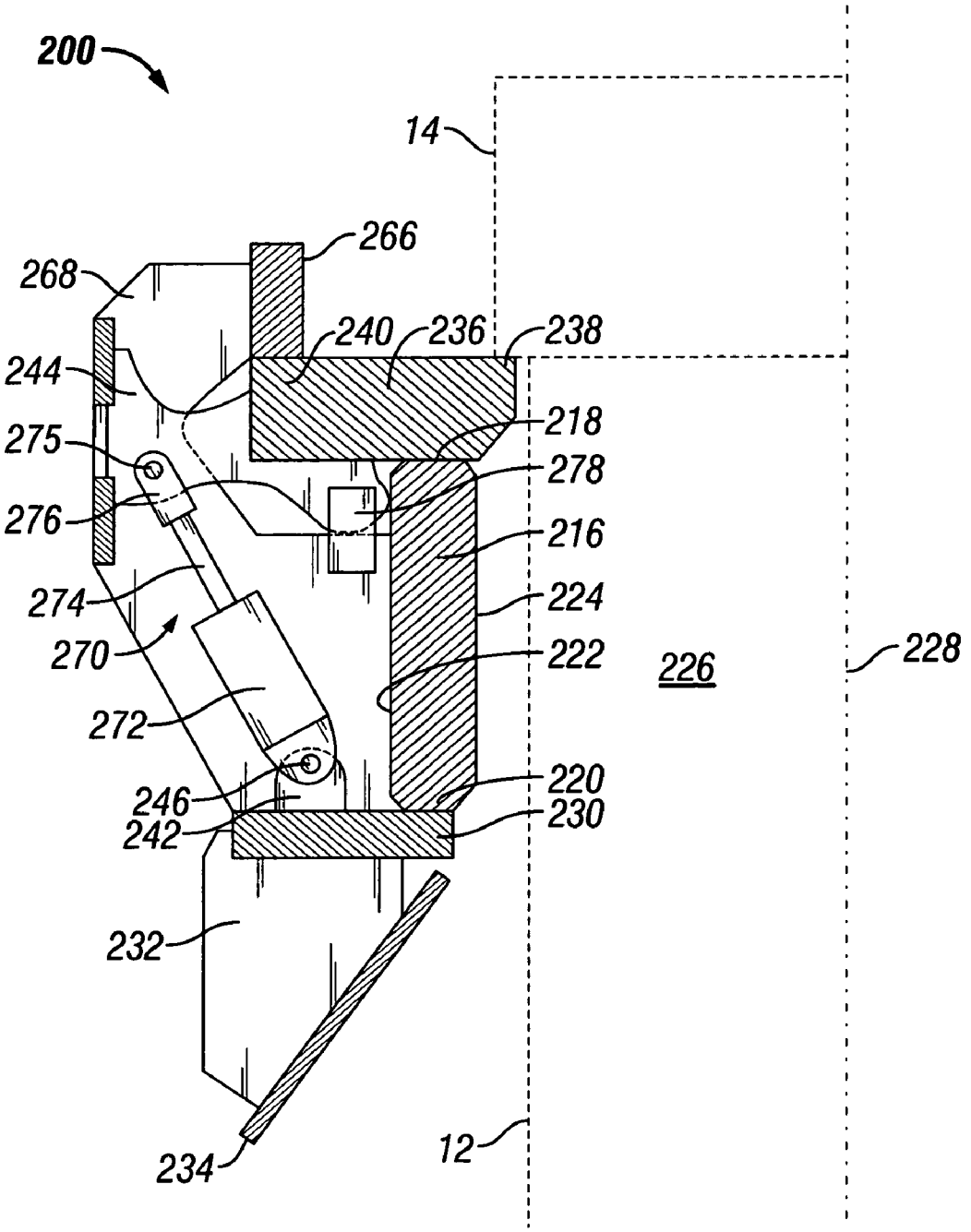
FIG. 4. is a conceptual schematic side view, in partial section of a third form of Basic Form I of the invention.

Referring now to FIG. 4, a third form of an apparatus for manipulating well bore tubing having a collar, in accordance with this invention, is indicated generally by the reference number 200. The same reference numerals as used in FIG. 1 identify well bore tube 12 and collar portion 14, and includes a circular body 216 having a top 218, bottom 220, outer side 222, inner side 224 and central cavity 226. Cavity 226 is centered on body axis 228 and has a diameter sufficient to admit through cavity 226 the entire width of a well bore tube 12, including collar portion 14, that is to be received for manipulation by apparatus 200. The bottom 220 of circular body 216 is affixed to an annular floor plate 230 that surmounts a gusseting plate 232 of a frusto-conical member 234 tapering inwardly toward cavity 226 to guide body 216 over a well bore tube 12 that is to be received within cavity 226.

Horizontally supported on top 218 of circular body 216 is a petal plate 236 that has a radially inner portion 238 and a radially outer portion 240. FIG. 4 shows one of a plurality of petal plates so disposed. The other plates (not shown) are spaced apart around top 218 of circular body 216. Circular body 216 that supports petal plates 236 is a fulcrum when the weight of a well bore tube 12 is impressed on the innermost portion 238 of the petal plates 236. This occurs when the petal plates 236, in extended position, as hereinafter described, support the weight of the well bore tube 12. To counter the force moment of such load on petal plates 236, a circular counterforce member or ring 266 surrounds body 216, horizontally spaced radially outward from body 216, and is positioned above and adjacent the top of the outer portion 240 of petal plates 236 including when they are extended into the cavity. Counterforce ring 266 is secured atop pedal plates 236 by a buttress member 268 affixed relative to the body 216, as seen in FIG. 4 at the inner side 222 and top 218 of body 216. Each buttress 268 is interposed between adjacent spaced petal plates 236.

A flange 242 is affixed to floor plate 230. Flange 242 pivotally mounts the cylinder 272 of a piston and cylinder assembly 270 on a pivot pin 246, pivotally fixing the cylinder relative to the body. Extending from the piston of the cylinder and piston assembly 270 is a rod 274, the end 276 distal to the piston being pivotally mounted on a pin 275 fastened to a link 244 that is affixed to petal plate 236. A slideway substantially normal to axis 228 of cavity 226 is provided for link 244 to slide radially inwardly and outwardly respectively to and from cavity 226 by opposing channel members, one of which, indicated by reference numeral 278, is viewable in FIG. 4. Slide link 244 is reciprocated by the action of rod 274, connected to the piston of cylinder and piston assembly 270 moved by force of fluid admitted into or withdrawn from the cylinder within which the piston reciprocates. On retraction of rod 274, pin 275 moves link 244 radially inward, causing a petal plate 236 among the plurality of such plates horizontally supported on top 218 of body 216 to move radially inward to an extent positioning a radially innermost portion 238 of plates 236 within cavity 226 of body 216 sufficiently to prevent passage of collar portion 14 through cavity 226. To release the tubing, rod 274 is extended from cylinder and piston assembly 270, thereby moving link slide 244 radially away from cavity 226, causing petal plate 236 among the plurality of such plates to move radially inwardly to an extent removing the innermost portion 238 of plates 236 from cavity 226 of body 216, allowing passage of collar portion 14 through cavity 226.

Figure 5:
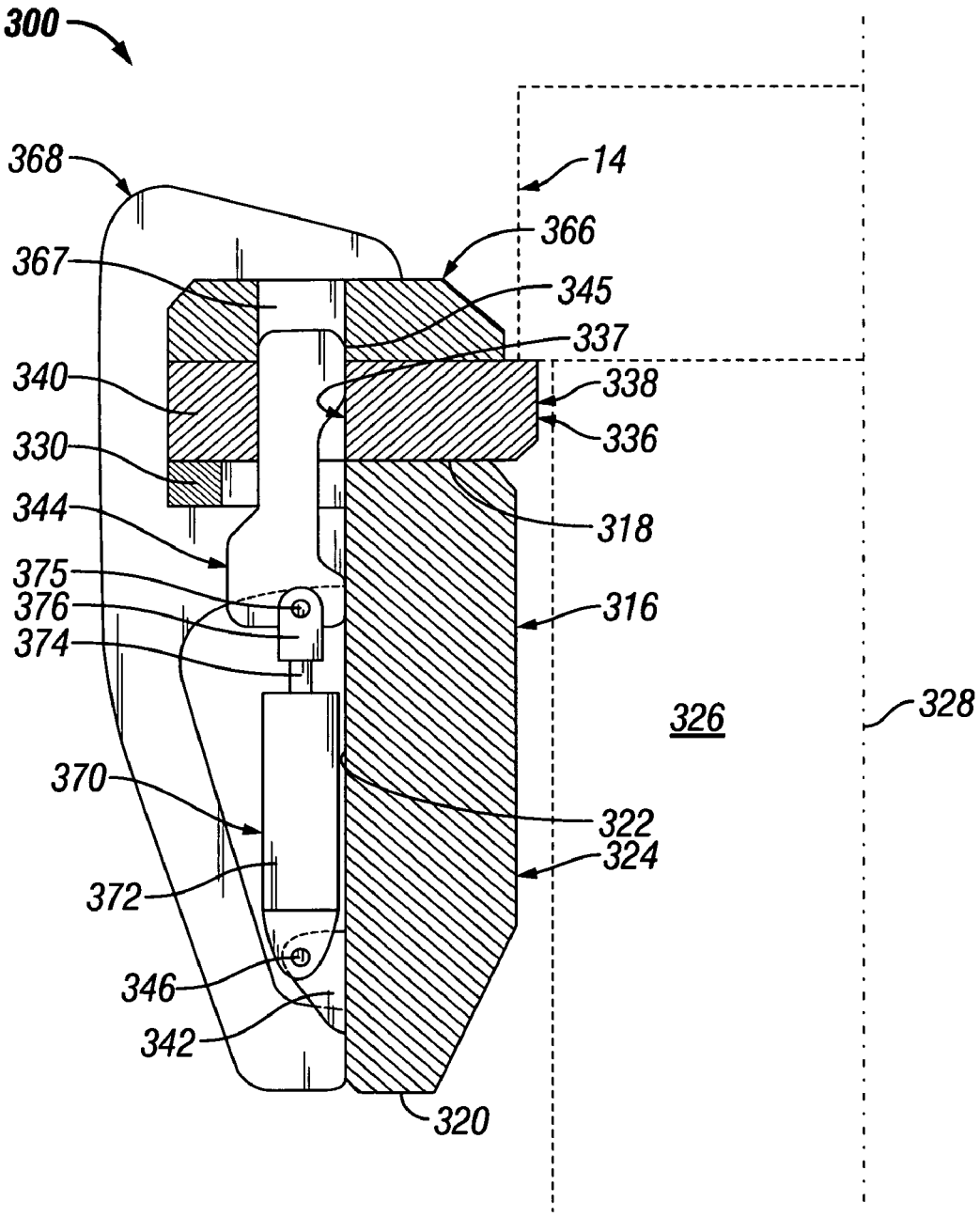
FIG. 5 is a conceptual schematic side view, in partial section of a fourth form of Basic Form I of the invention.

Referring now to FIG. 5, a fourth form of an apparatus for manipulating well bore tubing having a collar, in accordance with this invention, is indicated generally by the reference number 300. The same reference numerals as used in FIG. 1 identify well bore tube 12 and collar portion 14. Apparatus 300 includes a circular body 316 having a top 318, bottom 320, outer side 322, inner side 324 and central cavity 326. Cavity 326 is centered on body axis 328 and has a diameter sufficient to admit through cavity 326 the entire width of a well bore tube 12, including collar portion 14, that is to be received for manipulation by apparatus 300. Although not illustrated in FIG. 5, suitably, as shown by FIGS. 1 and 4, the bottom 320 of circular body 316 may affixed to an annular floor plate that surmounts a gusseting plate of a frusto-conical member tapering inwardly toward cavity 326 to guide body 316 over a well bore tube 12 that is to be received within cavity 326.

Horizontally supported on top 318 of circular body 316 is a petal plate 336 that has a radially inner portion 338 and a radially outer portion 340. FIG. 5 shows one of a plurality of petal plates so disposed. The other plates (not shown) are spaced apart around top 318 of circular body 316; see and compare FIG. 3. Circular body 316 that supports petal plates 336 is a fulcrum when the weight of a well bore tube 12 is impressed on the innermost portion 338 of the petal plates 336. This occurs when the petal plates 336, in extended position, as hereinafter described, support the weight of the well bore tube 12. To counter the force moment of such load on petal plates 336, a circular counterforce member or bolster ring 366 at least partially surrounds body 316, horizontally spaced radially outward from body 316, and is positioned above and adjacent the top of the outer portion 340 of petal plates 336 including when they are extended into cavity 326. Counterforce bolster ring 366 is secured atop pedal plates 336 by a buttress member 368 affixed relative to the body 316, as seen in FIG. 5 at the inner side 322 of body 316. Each buttress 368 is interposed between adjacent spaced petal plates 336 (compare FIG. 3).

A flange 342 is affixed to body 316 near the bottom 320 thereof. Flange 342 pivotally mounts the cylinder 372 of a piston and cylinder assembly 370 on a pivot pin 346, pivotally fixing the cylinder relative to the body. Extending from the piston of the cylinder and piston assembly 370 is a rod 374, the end 376 distal to the piston being pivotally mounted on a pin 375 fastened to an elongate cam 344 that slidingly engages petal plate 336. Cam 344 is located radially outward from body 316 and is linearly moveable parallel to cavity axis 328. Cam 344 is received in an aperture 337 in petal plate 336 between inner portion 338 and outer portion 340 and in aperture 367 in counterforce bolster ring 366. Cam 344 is reciprocated by the action of rod 374, connected to the piston of cylinder and piston assembly 370 moved by force of fluid admitted into or withdrawn from the cylinder within which the piston reciprocates. On retraction of rod 374, pin 375 moves cam 344 downward, parallel to axis 328, causing the radially inward surface of aperture 337 of petal plate 336, among the plurality of such plates horizontally supported on top 318 of body 316, to slide up cam ramp 345, and, pushed by cam 344, move petal plate 336 radially inward, positioning radially innermost portion 338 of petal plate 336 within cavity 326 of body 316 sufficiently, with the other petal plates, similarly actuated, to prevent passage of collar portion 14 through cavity 326. To release tubing 12, rod 374 is extended from cylinder and piston assembly 370, thereby moving cam 344 to slide petal plate 336 down cam ramp 345 and, relieved from displacement by ram 345, move radially away from cavity 326, and with the similar actuation of the plurality of the other such petal plates 336, to move radially outwardly to an extent removing the innermost portion 338 of petal plates 336 from cavity 326 of body 316, allowing passage of collar portion 14 through cavity 326.

Figure 6:
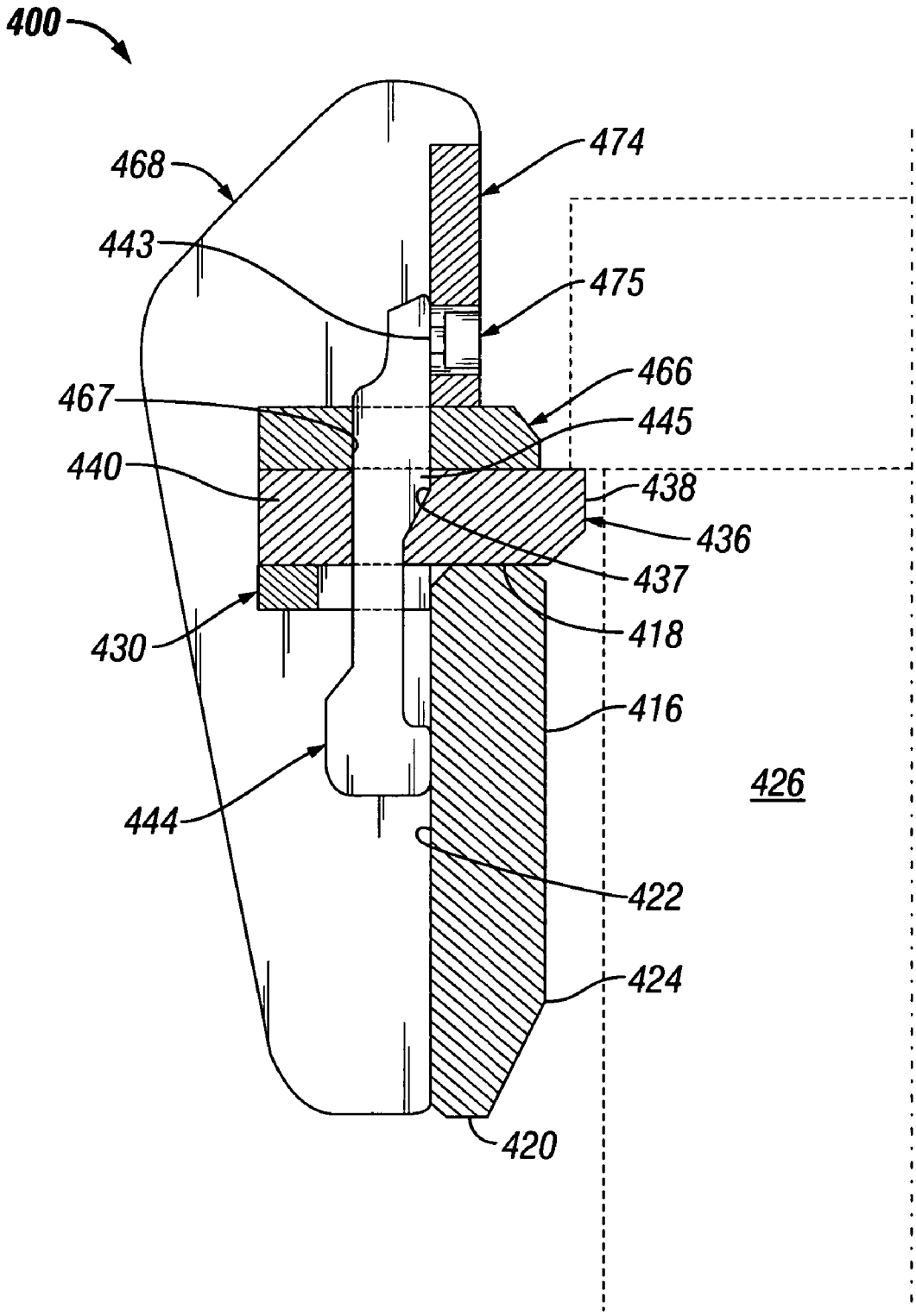
FIG. 6 is a conceptual schematic side view, in partial section of a fifth form of Basic Form I of the invention.

Referring now to FIG. 6, a fifth form of an apparatus for manipulating well bore tubing having a collar, in accordance with this invention, is indicated generally by the reference number 400. The well bore tube 12 and collar portion 14 in are to be understood to be present in the positions depicted in FIGS. 1–5, although not illustrated in FIG. 6. Apparatus 400 includes a circular body 416 having a top 418, bottom 420, outer side 422, inner side 424 and central cavity 426. Cavity 426 is centered on a body axis, as in the embodiments illustrated in FIGS. 1–5, and has a diameter sufficient to admit through cavity 426 the entire width of a well bore tube 12, including collar portion 14, that is to be received for manipulation by apparatus 400. Although not illustrated in FIG. 6, suitably, as shown by FIGS. 1 and 4, the bottom 420 of circular body 416 may affixed to an annular floor plate that surmounts a gusseting plate of a frusto-conical member tapering inwardly toward cavity 426 to guide body 416 over a well bore tube 12 that is to be received within cavity 426.

Horizontally supported on top 418 of circular body 416 is a petal plate 436 that has a radially inner portion 438 and a radially outer portion 440. FIG. 6 shows one of a plurality of petal plates so disposed. The other plates (not shown) are spaced apart around top 418 of circular body 416; see and compare FIG. 3. Circular body 416 that supports petal plates 436 is a fulcrum when the weight of a well bore tube 12 is impressed on the innermost portion 438 of the petal plates 436. This occurs when the petal plates 436, in extended position, as hereinafter described, support the weight of the well bore tube 12. To counter the force moment of such load on petal plates 436, a circular counterforce member or bolster ring 466 at least partially surrounds body 416, horizontally spaced radially outward from body 416, and is positioned above and adjacent the top of the outer portion 440 of petal plates 436 including when they are extended into cavity 426. Counterforce ring 466 is secured atop pedal plates 436 by a buttress member 468 affixed relative to the body 416, as seen in FIG. 6, at the inner side 422 of body 416. Each buttress 468 is interposed between adjacent spaced petal plates 436 (compare FIG. 3).

Elongate cam 444 is located radially outward from body 416 and is linearly moveable parallel to the cavity axis. Cam 444 is received in an aperture 437 in petal plate 436 between inner portion 438 and outer portion 440 and in aperture 467 in counterforce bolster ring 466. Elongate cam 444 includes a portion 443 above the elevation of petal plate 436 when the petal plates 436 are retracted. Ring cam 474 is located adjacent elongate cam portion 443 between elongate cam portion 443 and cavity 426 over body 416. One of elongate cam portion 443 and ring cam 474 contains a helical groove facing the other of 443 and 474, and the other of 443 and 474 contains a pin facing the helical groove, whereby upon rotation of ring cam 474 in one rotational direction about cavity axis 428, the pin follows the groove and moves elongate cam 444 in one linear direction parallel to the cavity axis, and upon rotation of ring cam 474 in a rotational direction about the cavity axis opposite to the one direction, the pin follows the groove and moves the elongate cam 444 parallel to the cavity axis in a linear direction opposite to the one linear direction. In FIG. 6, the helical groove (not seen) is formed in elongate cam portion 443, and ring cam 474 moves a pin 475 in the helical groove, elevating elongate cam 444 when pin 475 is caused by rotation of ring cam 474 to move upward in the groove, and lowering elongate cam 444 when pin 475 is caused by rotation of ring cam 474 to move downward in the groove.

Figure 7:
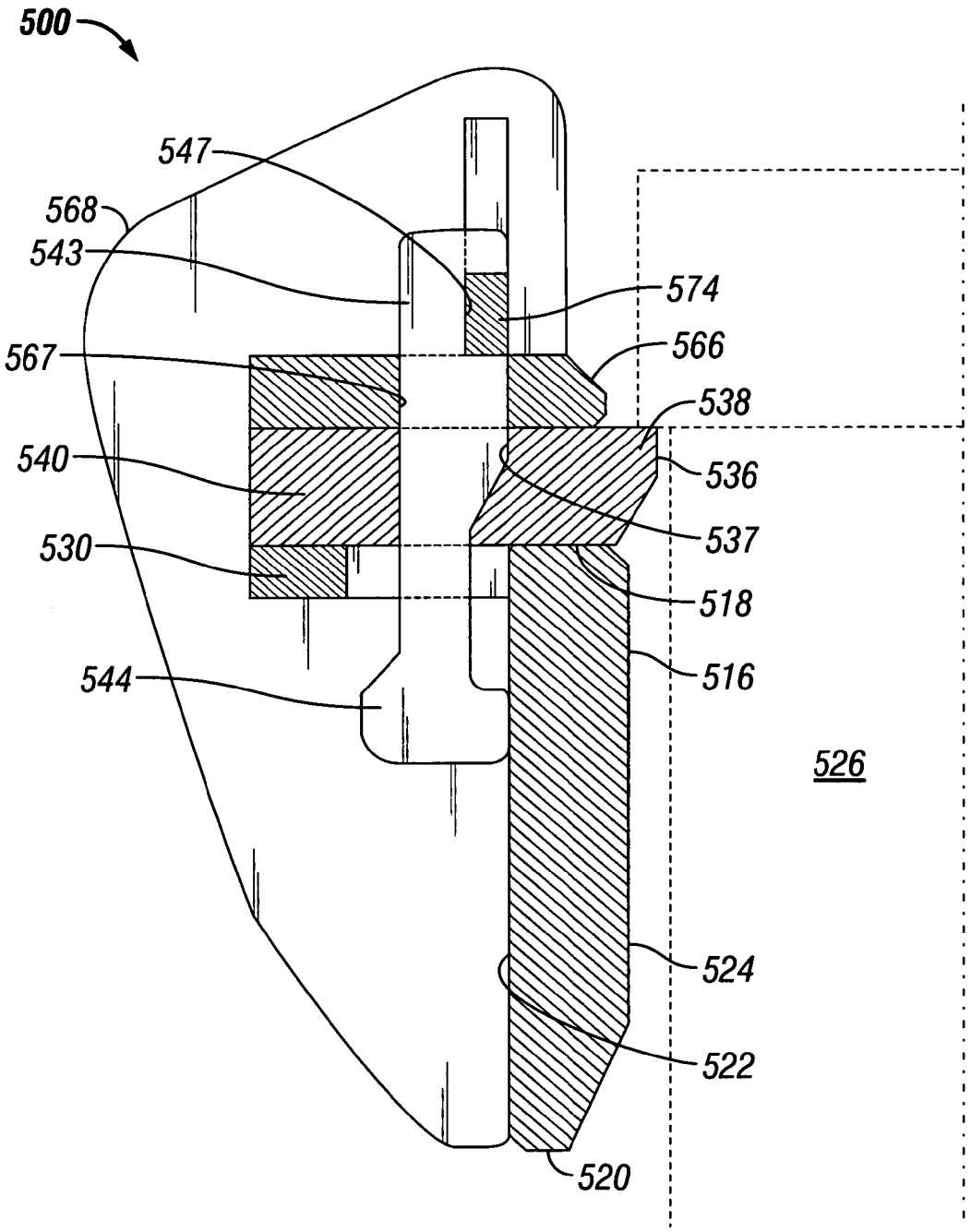
FIG. 7 is a conceptual schematic side view, in partial section, of a sixth form of Basic Form I of the invention.

Referring now to FIG. 7, a sixth form of an apparatus for manipulating well bore tubing having a collar, in accordance with this invention, is indicated generally by the reference number 500. The well bore tube 12 and collar portion 14 in are to be understood to be present in the positions depicted in FIGS. 1–5, although not illustrated in FIG. 7. Apparatus 500 includes a circular body 516 having a top 518, bottom 520, outer side 522, inner side 524 and central cavity 526. Cavity 526 is centered on the body axis, as in the embodiments illustrated in FIGS. 1–5, and has a diameter sufficient to admit through cavity 526 the entire width of a well bore tube 12, including collar portion 14, that is to be received for manipulation by apparatus 500. Although not illustrated in FIG. 7, suitably, as shown by FIGS. 1 and 4, the bottom 520 of circular body 516 may affixed to an annular floor plate that surmounts a gusseting plate of a frusto-conical member tapering inwardly toward cavity 526 to guide body 516 over a well bore tube 12 that is to be received within cavity 526.

Horizontally supported on top 518 of circular body 516 is a petal plate 536 that has a radially inner portion 538 and a radially outer portion 540. FIG. 6 shows one of a plurality of petal plates so disposed. The other plates (not shown) are spaced apart around top 518 of circular body 516; see and compare FIG. 3. Circular body 516 that supports petal plates 536 is a fulcrum when the weight of a well bore tube 12 is impressed on the innermost portion 538 of the petal plates 536. This occurs when the petal plates 536, in extended position, as hereinafter described, support the weight of the well bore tube 12. To counter the force moment of such load on the petal plates 536, a circular counterforce member or bolster ring 566 at least partially surrounds body 516, horizontally spaced radially outward from body 516, and is positioned above and adjacent the top of the outer portion 540 of petal plates 536, including when they are extended into cavity 526. Counterforce bolster ring 566 is secured atop pedal plates 536 by a buttress member 568 affixed relative to the body 516, as seen in FIG. 7 at the inner side 522 of body 516. Each buttress 568 is interposed between adjacent spaced petal plates 536 (compare FIG. 3).

Elongate cam 544 is located radially outward from body 516 and is linearly moveable parallel to cavity axis 526.

Cam 544 is received in an aperture 537 in petal plate 536 between inner portion 538 and outer portion 540 and aperture 567 of bolster ring 566. Elongate cam 544 includes a portion 543 above the elevation of petal plate 536 when the petal plates 536 are retracted. Portion 543 includes a recess 547 facing cavity 526. An annular reciprocation piece 574 is received in recess 543. Upon reciprocation of said annular reciprocation piece 574, cam portion 543 is moved linearly parallel to cavity axis 526.

Figure 8:
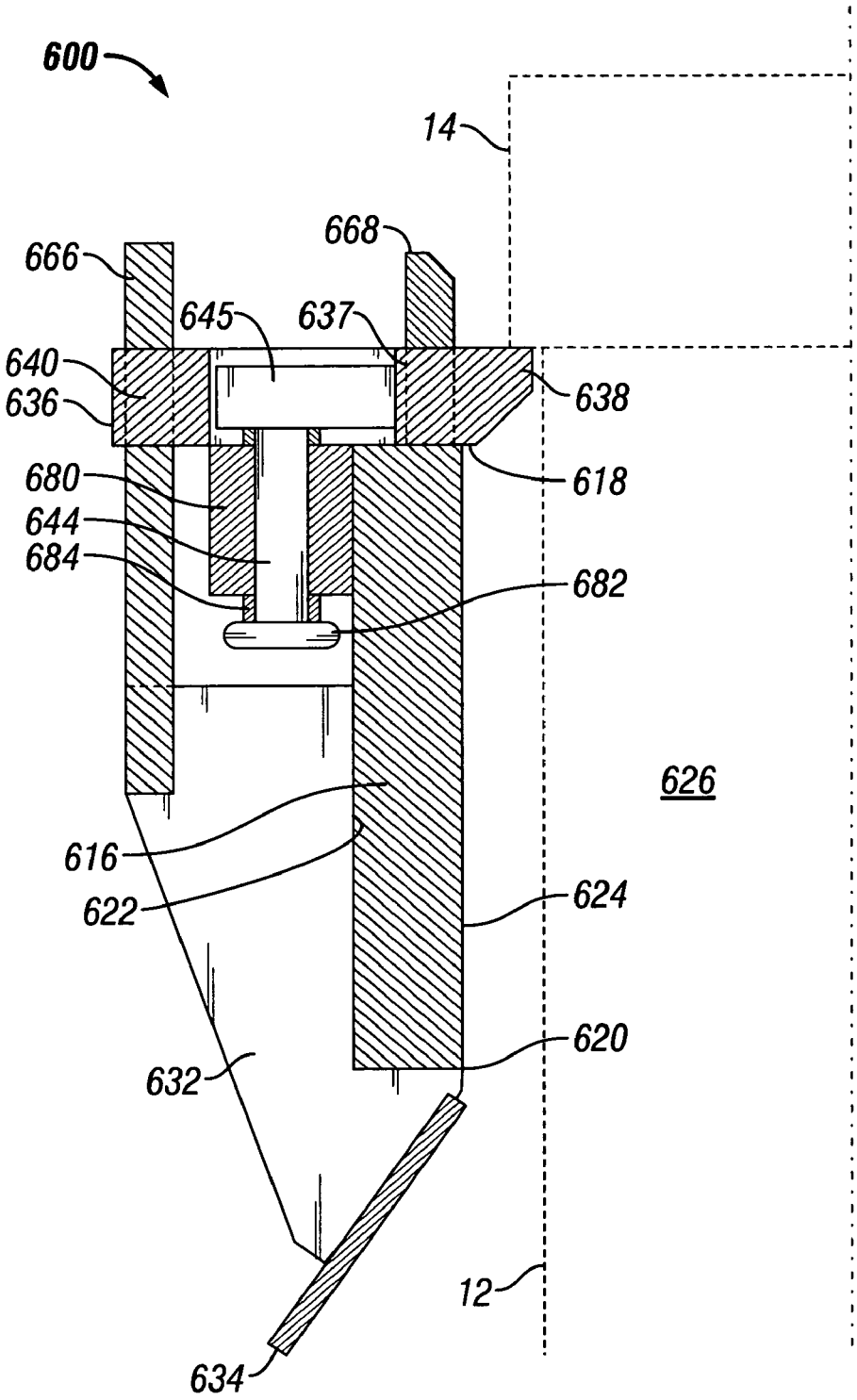
FIG. 8 is a conceptual schematic side view drawing, in partial section, of a seventh form of Basic Form I of the invention.

Referring to FIG. 8, a seventh form of the invention is indicated by the reference numeral 600. The same reference numerals as used in FIG. 1 identify well bore tube 12 and collar portion 14. Apparatus 600 includes a circular body 616 having a top 618, bottom 620, outer side 622, inner side 624 and central cavity 626. Cavity 626 is centered on a body axis (not shown, but understood; compare FIG. 1) and has a diameter sufficient to admit through cavity 626 the entire width of a well bore tube 12, including collar portion 14, that is to be received for manipulation by apparatus 600. The bottom 620 of circular body 616 is affixed to an annular gusseting plate 632 of a frusto-conical or funnel guide plate 634 that tapers inwardly toward cavity 626 to guide body 616 over a well bore tube 12 that is to be received within cavity 626.

Horizontally supported on top 618 of circular body 616 is a petal plate 636 that has a radially inner portion 638 and a radially outer portion 640. FIG. 8 shows one of a plurality of petal plates so disposed. The other plates (not shown) are spaced apart around top 618 of circular body 616; see and compare FIG. 3. Circular body 616 that supports petal plates 636 is a fulcrum when the weight of a well bore tube 12 is impressed on the innermost portion 638 of the petal plates 636. This occurs when the petal plates 636, in extended position, as hereinafter described, support the weight of the well bore tube 12. To counter the force moment of such load on petal plates 636, a circular counterforce member or bolster ring 666 at least partially surrounds body 616, spaced radially outward from body 616, and is positioned above and adjacent the top of the outer portion 640 of petal plates 636 including when they are extended into cavity 626. Counterforce bolster ring 666 is secured atop pedal plates 636 by a lower portion thereof 668 affixed relative to the body 616, as seen in FIG. 8, at the outer side 622 of body 616. An inner ring 668 vertically restrains petal plates 636 and guides then for radial movement.

Received within an aperture 637 in petal plate 636 between inner portion 638 and outer portion 640 is an eccentric cam lobe 645 on cam shaft 644 substantially parallel to the body axis and supported in bearing 680. Cam shaft 644 terminates in a sprocket 682 held from bearing 680 by spacer 684. Sprocket 682 may be turned manually or by hydraulic, electric or pneumatic motors. The cam shafts for all the petal plates 636 are interconnected by a chain so that motivational force is applied to all of them together to move cam lobes 645 in unison. Cam lobe 645 rotates on the axis of shaft 644 and engages the radially inward surface of aperture 637 of petal plate 636, all cam lobes 645 doing the same for all the petal plates horizontally supported on top 618 of body 616. Followingly pushed by cam lobe 645, petal plate 636 is moved radially inward, positioning radially innermost portion 638 of petal plate 616 within cavity 626 of body 616 sufficiently, with the other petal plates, similarly actuated, to prevent passage of collar portion 14 through cavity 626. To release tubing 12 from apparatus 600, cam shafts 644 are rotated to move the eccentric of cam lobe 645 away from the radially inner surface of aperture 637 towards the radially outer surface of aperture 637, to impress eccentric lobe 645 onto the radially outer surface of petal plate aperture 637 and push petal plate 636 radially outward. The similar and coincident actuation of the other such petal plates 636, moves all petal plates 636 radially outwardly to an extent removing the innermost portion 638 of petal plates 636 from cavity 626 of body 616, allowing passage of collar portion 14 through cavity 626. In the foregoing fashion petal plates 636 at their apertures 637 function as a cam follower.

From the foregoing, it will be understood that in operation the embodiments of FIGS. 1–8 perform a method of the invention for manipulating well bore tubing, that comprises: introducing tubing 12 into the cavity 26, 126, 226, 326, 426, 526 or 626, respectively, of a circular body 16, 116, 216, 316, 416, 516 or 616 having a central cavity of diameter to admit therethrough a collar portion 14 of tubing 12; positioning body 16, 116, 216, 316, 416, 516 or 616 below collar portion 14 of tubing 12; and moving a plurality of petal plates, respectively, 36, 136, 236, 336, 436, 536 or 636 horizontally supported on and spaced apart around the top, respectively 18, 118, 218, 318, 418, 518 or 618 of body 16, 116, 216, 316, 416, 516 or 616 radially inward, substantially normal to the body axis, respectively, over body, 16, 116, 216, 316, 416, 516 or 616, into the cavity 26, 126, 226, 326, 426, 526 or 626, respectively, an extent sufficient to prevent passage of the collar portion 14 of tubing 12 through cavity 26, 126, 226, 326, 426, 526 or 626, respectively.

In respect to the invention in the forms described in respect to FIGS. 5, 6 and 7, petal plates 336, 436 and 536, respectively include apertures 337, 437 and 537 receiving elongate cams, respectively 344, 444, and 555, movable linearly parallel to the respective axes, respectively, of cavitys 326, 426, and 526, for sliding on plates 336, 436 and 536, and the step of moving petal plates 336, 436 or 536 comprises actuating elongate cam 344, 444, or 555, respectively, to ride plates 336, 436 or 536, respectively, on cam 344, 444, or 555. In the form of the invention described in respect to FIG. 5, the elongate cam 344 is actuated by a rod 374 of a piston moved by force of fluid admitted into or withdrawn from a cylinder within which the piston reciprocates, the cylinder being fixed relative to the body 316 and the piston rod end 376 distal from the piston attaching cam 344. In the embodiment depicted in FIG. 6, elongate cam 444 is actuated by rotating a ring cam 474 surrounding cavity 426 and operatively connected to said elongate cam 444 to translation the rotary motion of ring cam 474 to linear motion of elongate cam 444. In the form of the invention described in reference to FIG. 7, elongate cam 544 is actuated by reciprocating a ring 574 received in a recess 547 of an extended portion 543 of elongate cam 544.

In respect to the invention in the form described relative to FIG. 8, wherein petal plates 636 include an aperture 637 receiving a cam comprising an eccentric lobe 645 and a camshaft 644, located radially outwardly from body 616 and rotatable about shaft 644 axis substantially parallel to the axis of cavity 626, petal plates 636 are operated by rotating the cam eccentric 645 to push the proximal portion 638 of petal plates 636 in or out of body cavity 626.

In respect to the invention in the form described relative to FIG. 8, wherein petal plates 636 include an aperture 637 receiving a cam comprising an eccentric lobe 645 and a camshaft 644, located radially outwardly from body 616 and rotatable about shaft 644 axis substantially parallel to axis 628 of cavity 626, petal plates 636 are operated by rotating the cam eccentric 645 to push the proximal portion 638 of petal plates 636 in or out of body cavity 626.

In respect to the invention in the form of FIGS. 2, 3 and 4, where petal plates 136 and 236 are connected to a link 144 and 244, respectively, that reciprocates radially inwardly and outwardly substantially normal to the axis of cavitys 126 and 226 respectively, the step of moving petal plates 136 and 236 comprises moving links 144 and 244, respectively, radially inwardly to the extent sufficient to prevent passage of the collar portion 14 of tubing 12 through cavity 126 and 226, respectively. In these embodiments, links 144 and 244 are moved by a rod 174 and 274, respectively, of a piston moved by force of fluid admitted into or withdrawn from a cylinder within which the piston reciprocates, the cylinder being fixed relative to body 116 and 216, respectively, and the piston rod end 176 and 276, respectively, distal from the piston, attaching link 144 and 244 respectively.

In the embodiment described in respect to FIG. 1, petal plates 36 are connected to link 44 that pivots on an axis 46 transverse to the axis 28 cavity 26, and the step of moving comprises pivoting link 44 upwardly. Link 44 includes a finger 60 received within a capture 58 located on the interior of a sleeve 52 surrounding body 16 and moveable parallel to axis 28 of cavity 26, and the step of moving comprises moving sleeve 52 upwardly, suitably by the action of a rod of a piston moved by force of fluid admitted into or withdrawn from a cylinder within which the piston reciprocates, the cylinder being fixed relative to body 16, the piston rod end distal from the piston attaching sleeve 52.

As mentioned above, FIGS. 1–8 are conceptual drawings in which the elements of the invention are depicted in their relationship to one another, but in which the shape of the elements is neither the necessary shape nor are the elements presented in necessary scale or proportion in which they might be present in a constructed apparatus making use of the invention. For example, the body 16, 116, 216, 316, 416, 516, or 616 might (but need not) take the shape of the annular body depicted in the apparatus described in Basic Form III of the Invention.

In one application of the invention, the forms of the inventions could have a body 16, 116, 216, 316, 416, or 516 of cavity (respectively, 26, 126, 226, 326, 426 or 526) diameter of 33 inches, with a petal plate in extended position in the cavity having an inner diameter of 30⅜ inches for manipulating tubing whose body is 30 inches in outside diameter and that has a collar 32 inches in diameter. For further example, cylinder 370 of FIG. 5 might have an external diameter of 4 inches. In accordance with the invention, the forms of the invention can use interchangeable petal plates of different inner diameters to manipulate tubing of different external diameters, whether tubing body or collars or both.

Basic Form II of the Invention

Figure 9:
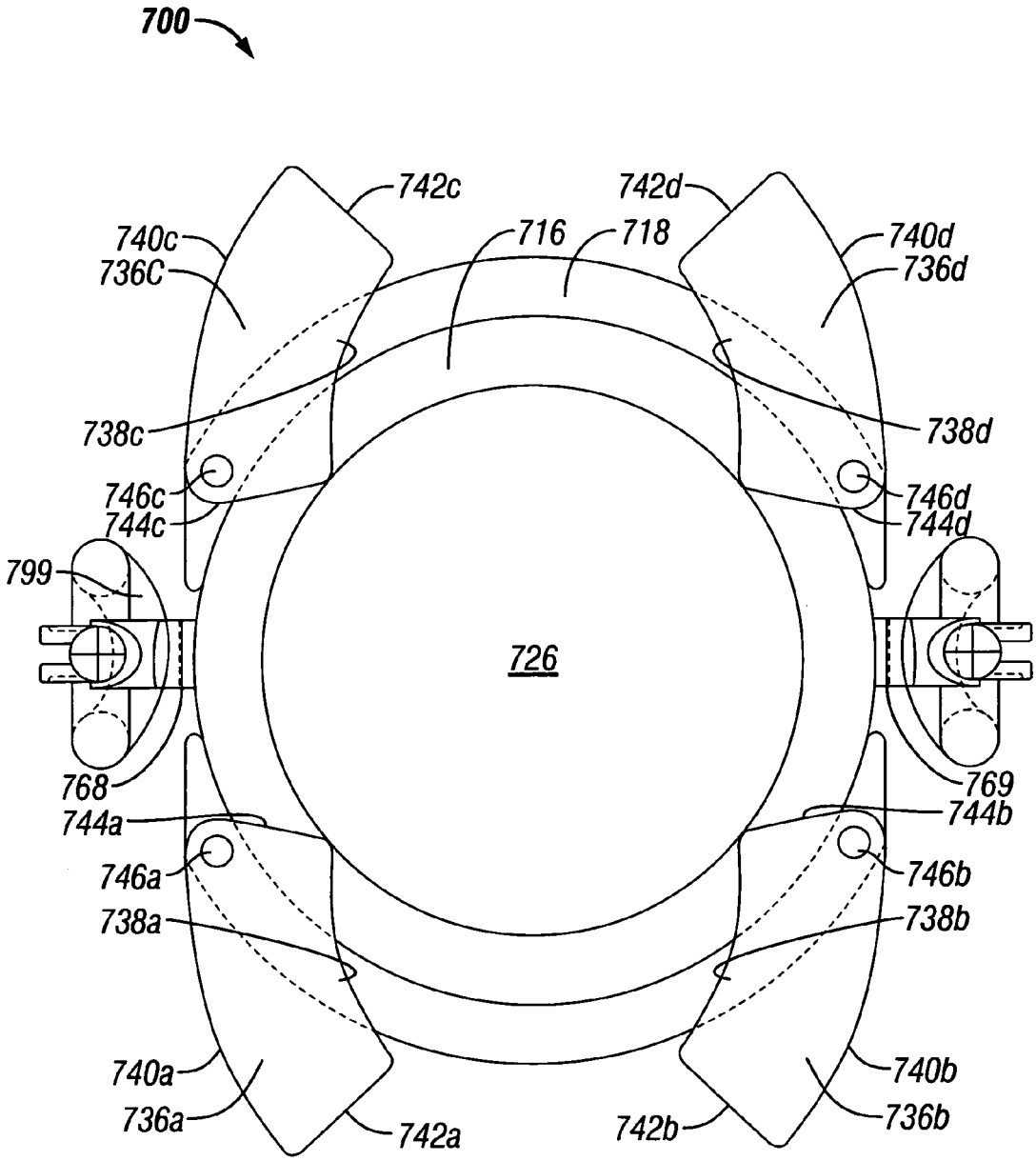
FIG. 9 is a top view of a form of the apparatus of Basic Form II of this invention with the arm plates in un-deployed position.

Referring to FIG. 9, a first form of an elevator apparatus of Basic Form II of this invention for manipulating well bore tubing having a collar is indicated generally by the reference numeral 700. Elevator apparatus 700 comprises an annular body 716 having a top 718 and a central cavity 726 around a body axis 728 (not shown, but understood to be in the center of the cavity). The cavity 726 has a diameter allowing the collar portion of the well bore tubing to pass longitudinally therethrough. A plurality of arm members, 736*a*, 736*b*, 736*c* and 736*d* are spaced apart around the top of body 716.

Arm members 736*a*, 736*b*, 736*c* and 736*d* each have an proximal portion, respectively, 738*a*, 738*b*, 738*c* and 738*d*, a distal portion, respectively, 740*a*, 740*b*, 740*c* and 740*d*, a front portion, respectively, 742*a*, 742*b*, 742*c* and 742*d*, and a rear portion, respectively 744*a*, 744*b*, 744*c* and 744*d*, and are each pivotal at their proximal portion around an arm member axis, respectively, 746*a*, 746*b*, 746*c* and 746*d*, parallel to the body axis. Arm members 736*a*, 736*b*, 736*c* and 736*d* pivot from a first position, where proximal portions 738*a*, 738*b*, 738*c* and 738*d* of arm members 736*a*, 736*b*, 736*c* and 736*d* are not within a projection of body cavity 716, for example, as shown in FIG. 9, to a second position where the proximal portions 738*a*, 738*b*, 738*c* and 738*d* of arm members 736*a*, 736*b*, 736*c* and 736*d* are inside a projection of the cavity, for example, as shown in FIG. 10.

Figure 10:
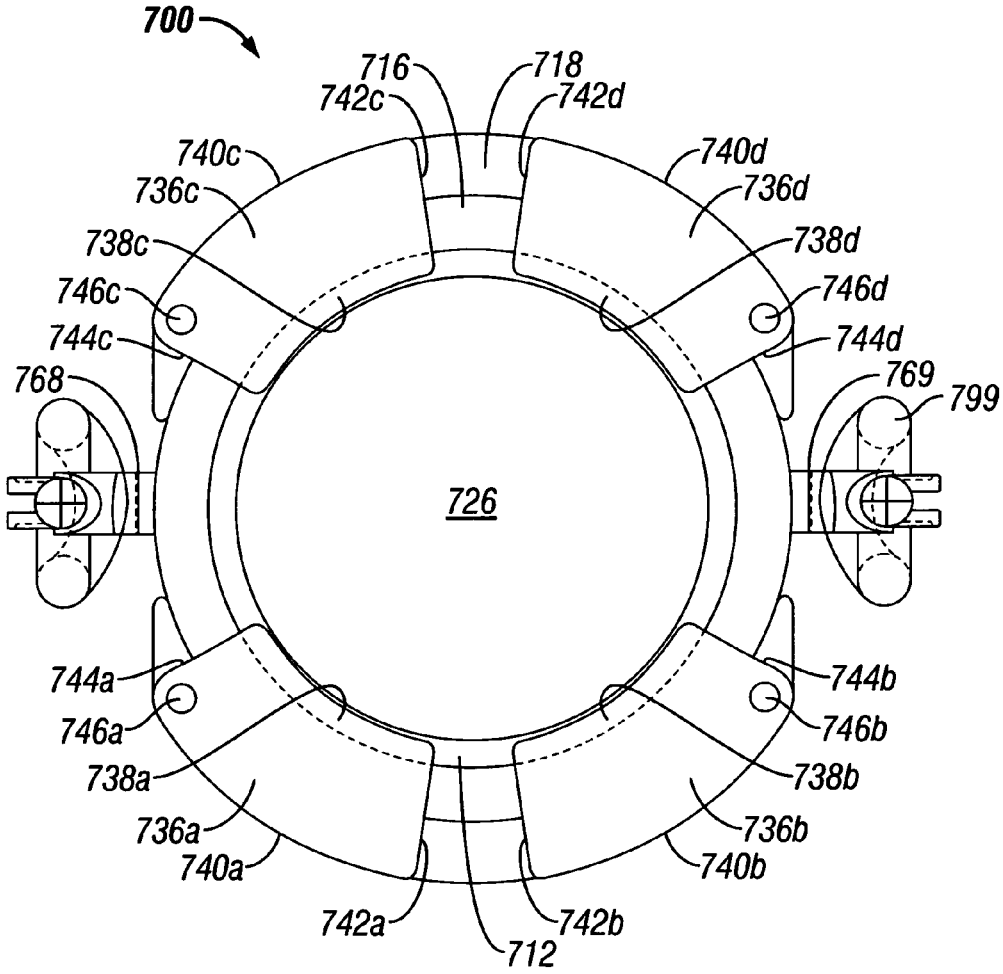
FIG. 10 is a top view of the apparatus of FIG. 9 with the arm plates in deployed position.

In the form of the invention shown in FIGS. 9 and 10, one arm member 736*a* of an arm member pair 736*a*, 736*b* pivots clockwise and the other arm member 736*b* of pair 736*a*, 736*b* pivots counterclockwise, to swing arm members 736*a*, 736*b* from a first or un-deployed position, as exemplified in FIG. 9, where the front portions 742*a* and 742*b* of arm members pair 736*a*, 736*b* (and the front portions 742*c* and 742*d* of arm member pair 736*c*, 736*d*) are removed from one another and the proximal portions 738*a* and 738*b* of arm member pair 736*a*, 736*b* (and the proximal portions 738*c*, 738*d* of arm member pair 736*c*, 736*d*) are not within a projection of body cavity 718, to a second or deployed position, as exemplified in FIG. 10, where the front portions 742*a* and 742*b* of arm member pair 736*a*, 736*b* (and the front portions 742*c* and 742*d* of arm member pair 736*c*, 736*d*) are adjacent one another and the proximal portions 738*a* and 738*b* of arm member pair 736*a*, 736*b* (and the proximal portions 738*c*, 738*d* of arm member pair 736*c*, 736*d*) are inside a projection of cavity 718.

An actuator operatively associated with arm members 736*a*, 736*b*, 736*c* and 736*d* suitably is a sprocket chain engaging toothed members affixed to a base of a shaft coincident with axes 746*a*, 746*b*, 746*c* and 746*d* (and indicated by the same reference numerals). Sprocket chain on the toothed members on shafts 746*a*, 746*b*, 746*c* and 746*d* comprises a chain drive suitably powered by hand or powered by pneumatic, hydraulic or electric motor (not depicted), a type of drive mechanism well known to those skilled in the art to which this invention pertains. The chain drive for shafts 746*a* and 746*b* suitably is a FIG. 8 configuration to provide the counterclockwise pivotation of arm member 736*a* and the clockwise pivotation of arm member 736*b*. Similarly, the chain drive for shafts 746*c* and 746*d* suitably is a FIG. 8 configuration to provide the counterclockwise pivotation of arm member 736*d* and the clockwise pivotation of arm member 336*c*. Alternatively, shafts 746*c* and 746*b* can be operated on one chain driven in a clockwise manner, and shafts 746*a* and 746*d* can be drive by another chain driven in a counterclockwise manner. When powered, the chain drive pivots each arm member 736*a*, 736*b*, 736*c*, and 736*d* about shafts 746*a*, 746*b*, 746*c* and 746*d*, respectively, to reversibly move the arm members from the first (un-deployed) position, where the collar portion of the tubing can pass through cavity 716, to the second (deployed) position, where the collar portion of the tubing is prevented by the proximal portions 738*a*, 738*b*, 738*c* and 738*d* of arm members 736*a*, 736*b*, 736*c* and 736*d* from passing through cavity 716. In the second (deployed) position, the proximal portions 738*a*, 738*b*, 738*c* and 738*d* of arm members 736*a*, 736*b*, 736*c* and 736*d* are seen to extend into cavity 716 allowing passage of the body 712 of tubing but preventing the passage of a collar portion of the tubing which is of material external diameter larger than the tubing body 712.

Lift appendages 768 and 769 are fixed to the lateral portions of body 716 for receipt of well draw work bails 799 from rig hook, to allow the draw works to raise or lower elevator body 716 in a well known manner.

Figure 11:
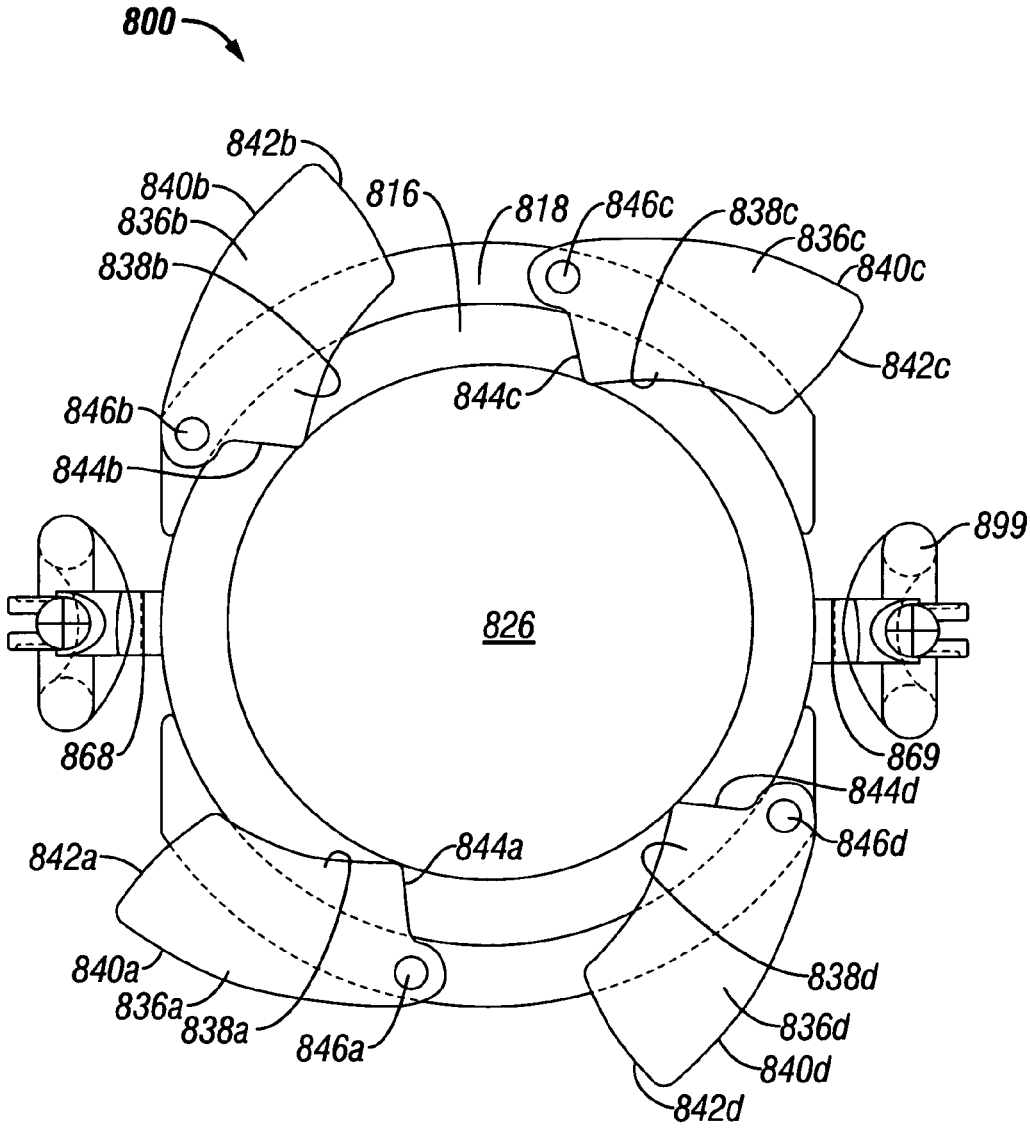
FIG. 11 is a top view of another form of the apparatus of Basic Form II of this invention with the arm plates in un-deployed position.
Figure 12:
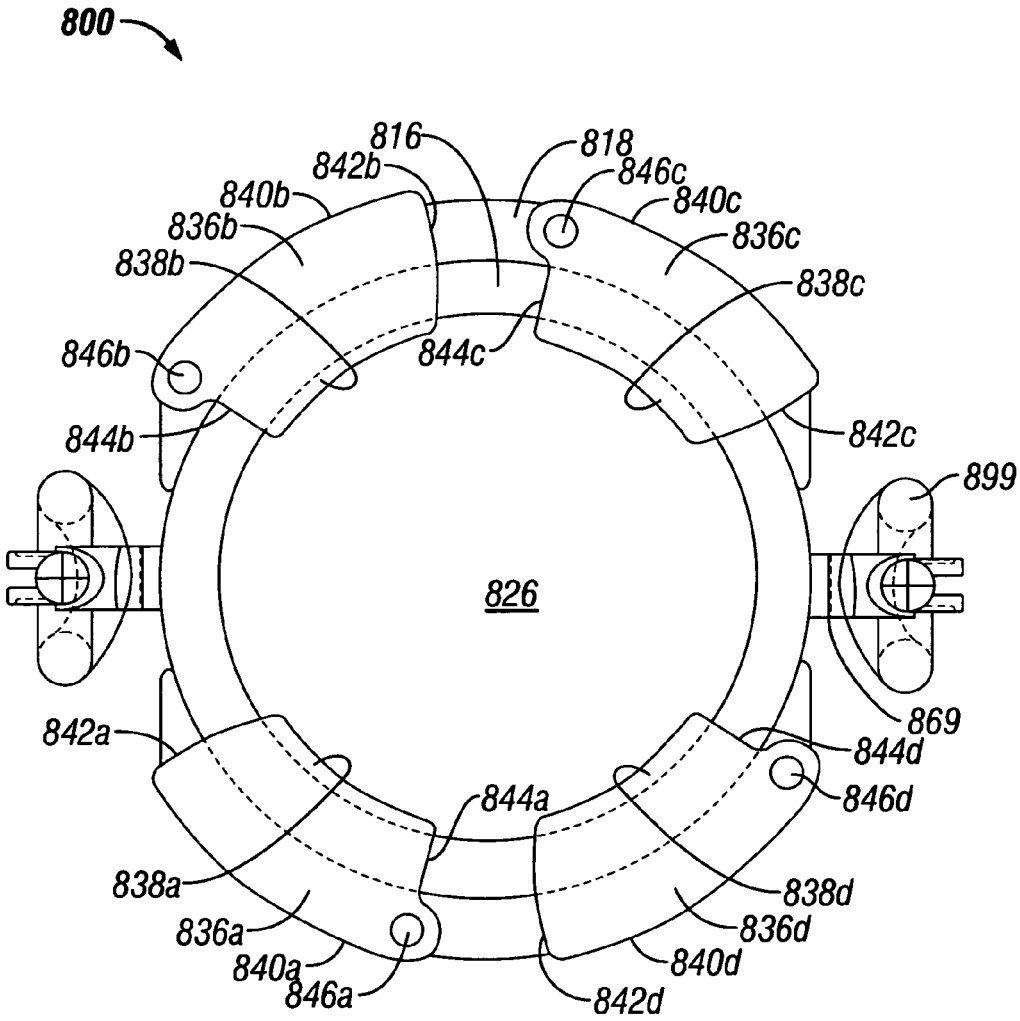
FIG. 12 is a top view of the apparatus of FIG. 11 with the arm plates in deployed position.

Referring now to FIGS. 11 and 12, another form of the invention is indicated by reference numeral 800. Elevator apparatus 800 comprises an annular body 816 having a top 818 and a central cavity 826 around a body axis 828. The cavity 826 has a diameter allowing the collar portion of the well bore tubing to pass longitudinally therethrough. A plurality of arm members 836*a*, 836*b*, 836*c* and 836*d* are spaced apart around the top 818 of body 816.

Arm members 836*a*, 836*b*, 836*c* and 836*d* each have an proximal portion, respectively, 838*a*, 838*b*, 838*c* and 838*d*, an distal portion, respectively, 840*a*, 840*b*, 840*c* and 840*d*, a front portion, respectively, 842*a*, 842*b*, 842*c* and 842*d*, and a rear portion, respectively 844*a*, 844*b*, 844*c* and 844*d*, and are each pivotal at their rear portion around an arm member axis, respectively, 846*a*, 846*b*, 846*c* and 846*d* that is parallel to body axis 828. Referring to arm members 836*a* and 836*b* as an example, the front portion 842*a* of arm member 836*a* is adjacent the rear portion 844*b* of a next adjacent arm member 836*b*. Similarly, the front portion 842*b* of arm member 836*b* is adjacent the rear portion 844*c* of a next adjacent arm member 836*c*, the front portion 842*c* of arm member 836*c* is adjacent the rear portion 844*d* of next adjacent arm member 836*d*, and the front portion 842*d* of arm member 836*d* is adjacent the rear portion 844*a* of a next adjacent arm member 836*a*. All arm members 836*a*, 836*b*, 836*c* and 836*d* pivot in the same direction (in FIGS. 11 and 12, clockwise) to swing the arm members from a first (un-deployed) position, as exemplified in FIG. 11, to a deployed position as exemplified in FIG. 12. Referring to FIG. 11, in the un-deployed position of arm members 836*a*, 836*b*, 836*c*, and 836*d*, the front portions 842*a*, 842*b*, 842*c*, and 842*d*, respectively, are removed from the rear portions, respectively, 844*b*, 844*c*, 844*d* and 844*a*, of the next adjacent arm members in the direction of swing, and the proximal portions, respectively 838*a*, 838*b*, 838*c* and 838*d*, of arm members 836*a*, 836*b*, 836*c* and 836*d*, are not within a projection of body cavity 826. In the second or deployed position, exemplified in FIG. 12, the front portions 842*a*, 842*b*, 842*c*, and 842*d*, respectively, are adjacent the rear portions, respectively 844*b*, 844*c*, 844*d* and 844*a*, of the next adjacent arm members in the direction of swing, and proximal portions respectively 838*a*, 838*b*, 838*c* and 838*d*, of arm members 836*a*, 836*b*, 836*c* and 836*d*, are inside a projection of body cavity 826.

An actuator operatively associated with arm members 836*a*, 836*b*, 836*c* and 836*d* suitably is a sprocket chain engaging toothed members affixed to a base of a shaft coincident with axes 846*a*, 846*b*, 846*c* and 846*d* (and indicated by the same reference numerals). Sprocket chain on the toothed members on shafts 846*a*, 846*b*, 846*c* and 846*d* comprises a chain drive suitably manipulated by hand or powered by pneumatic, hydraulic or electric motor (not depicted), a type of drive mechanism well known to those skilled in the art to which this invention pertains. The chain drive for shafts 846*a*, 846*b*, 846*c* and 846*d* can be operated on one chain driven in a clockwise manner, for the arrangement shown in FIGS. 11 and 12, to move the arm members into the deployed position, and reversed to move the arm members into the un-deployed position. More particularly, when powered, the chain drive pivots each arm member 836*a*, 836*b*, 836*c*, and 836*d* about shafts 846*a*, 846*b*, 846*c*, and 846*d*, respectively, to reversibly move the arm members 836*a*, 836*b*, 836*c* and 836*d* from the first (un-deployed) position, where the collar portion of the tubing can pass through cavity 826, to the second (deployed) position, where the collar portion of the tubing is prevented by the proximal portions 838*a*, 838*b*, 838*c* and 838*d* of arm members 836*a*, 836*b*, 836*c* and 836*d* from passing through cavity 826.

Lift appendages 868 and 869 are fixed to the lateral portions of body 816 for receipt of well draw work bails 899 from rig hook, to allow the draw works to raise or lower elevator body 816 in a well known manner.

As mentioned above, the term "cavity" as used for Basic Form II of the invention means an opening or passage through the body and a projection of the cavity adjacent the body. Thus, while the embodiments depicted in FIGS. 9–12 position the arm members 736*a*, 736*b*, 736*c* and 736*d* on top 718 of body 716 (and position the arm members 836*a*, 836*b*, 836*c* and 836*d* on top 818 of body 816), such that the proximal portions 738*a*, 738*b*, 738*c*, and 738*d* of arm members 736*a*, 736*b*, 736*c*, and 736*d* are within a projection of the opening or passage 726 through body 716 (and the proximal portions 838*a*, 838*b*, 838*c*, and 838*d* of arm members 836*a*, 836*b*, 836*c*, and 836*d* are within a projection of the opening or passage 826 at the top of body 716), it is within the scope of the invention to position arm members 736*a*, 736*b*, 736*c*, and 736*d* within body 716 (and arm members 836*a*, 836*b*, 836*c* and 836*d* within body 816), such that the proximal portions 738*a*, 738*b*, 738*c*, and 738*d* of arm members 736*a*, 736*b*, 736*c*, and 736*d* are within of the opening or passage 726 itself (and the proximal portions 838*a*, 838*b*, 838*c*, and 838*d* of arm members 836*a*, 836*b*, 836*c*, and 836*d* are within the opening or passage 826 itself), or to position arm members 736*a*, 736*b*, 736*c*, and 736*d* at the bottom of body 716 (and arm members 836*a*, 836*b*, 836*c* and 836*d* at the bottom of body 816), such that the proximal portions 738*a*, 738*b*, 738*c*, and 738*d* of arm members 736*a*, 736*b*, 736*c*, and 736*d* are within a projection of the opening or passage 726 at the bottom of body 716 (and the proximal portions 838*a*, 838*b*, 838*c*, and 838*d* of arm members 836*a*, 836*b*, 836*c*, and 836*d* are within a projection of the opening or passage 826 at the bottom of body 816), so long as the arm members are spaced apart around the body and pivotable at one end of the arm member around an arm member axis parallel to the body axis, from a first or un-deployed position where portions of the arm members proximal to the cavity are outside the body "cavity", to a second position where the proximal portions of the arm members extend into the "cavity".

FIGS. 9–12 are conceptual drawings in which the elements of the invention are depicted in their relationship to one another, but in which the shape of the elements is neither the necessary shape nor are the elements presented in necessary scale or proportion in which they might be present in a constructed apparatus making use of the invention. In accordance with the invention, the forms of the invention can use arm plates of different inner diameters to manipulate tubing of different external diameters, whether tubing body or collars or both.

Basic Form III of the Invention

Figure 13:
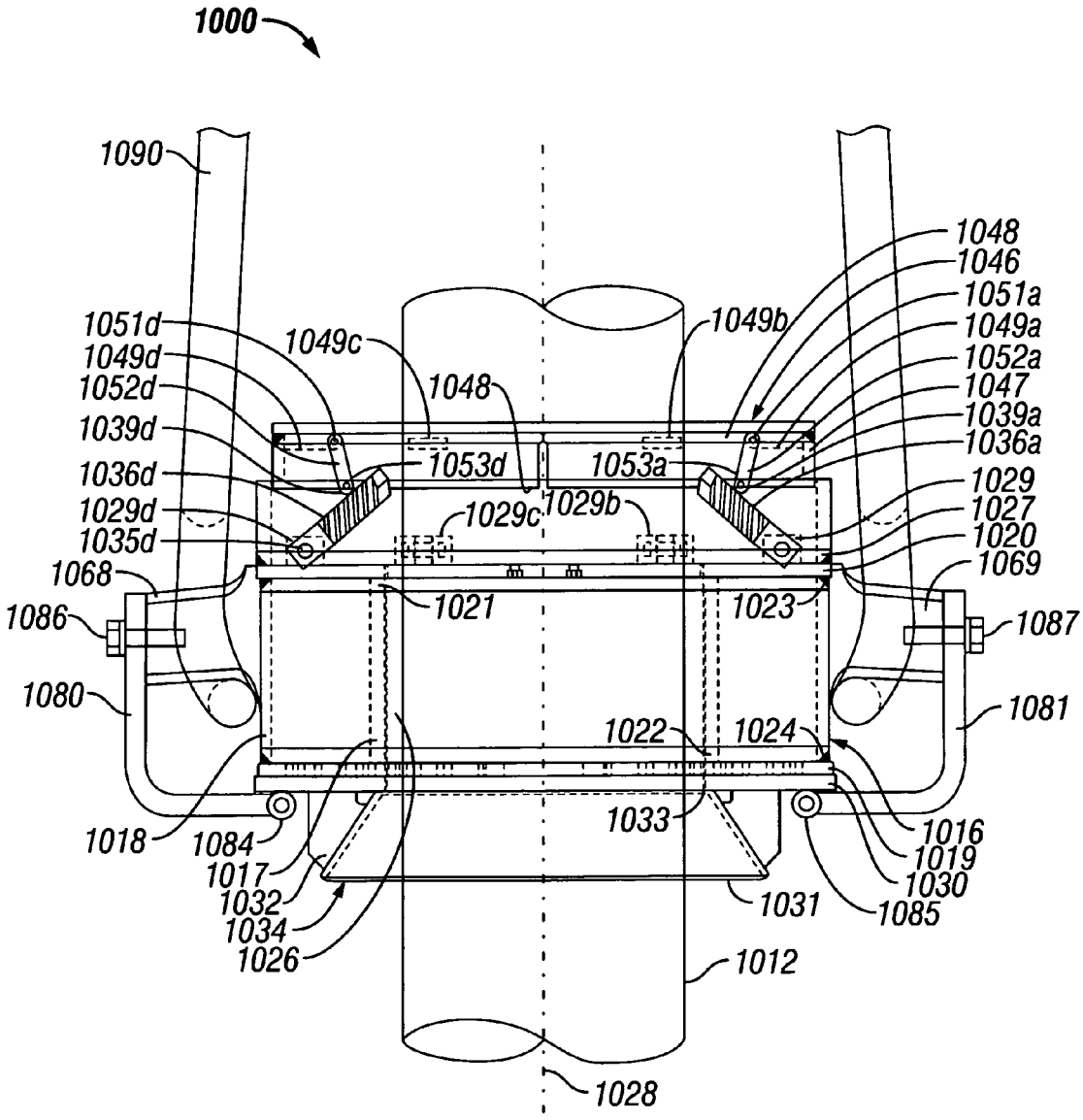
FIG. 13 is a side view of an embodiment of Basic Form III of this invention, useful for manipulating well casing, showing flap plates in elevated position.
Figure 14:
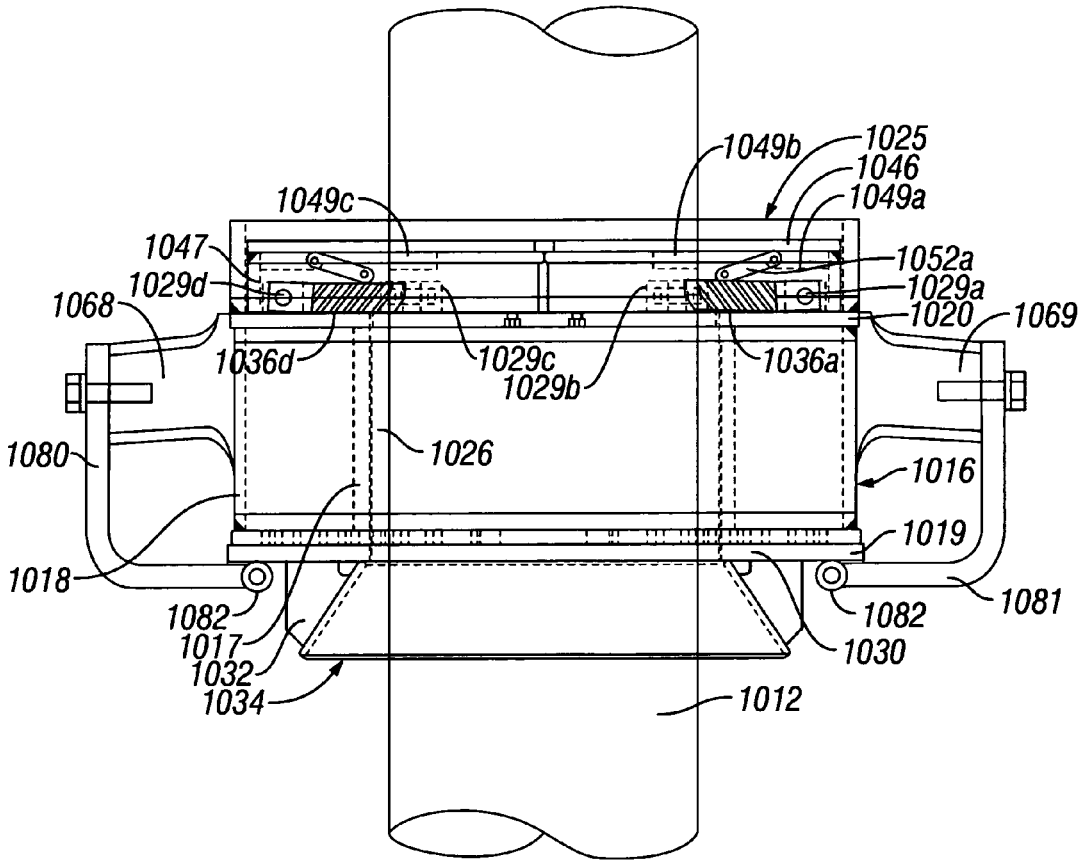
FIG. 14 is another side view of the embodiment of FIG. 1, showing flap plates in lowered position.
Figure 15:
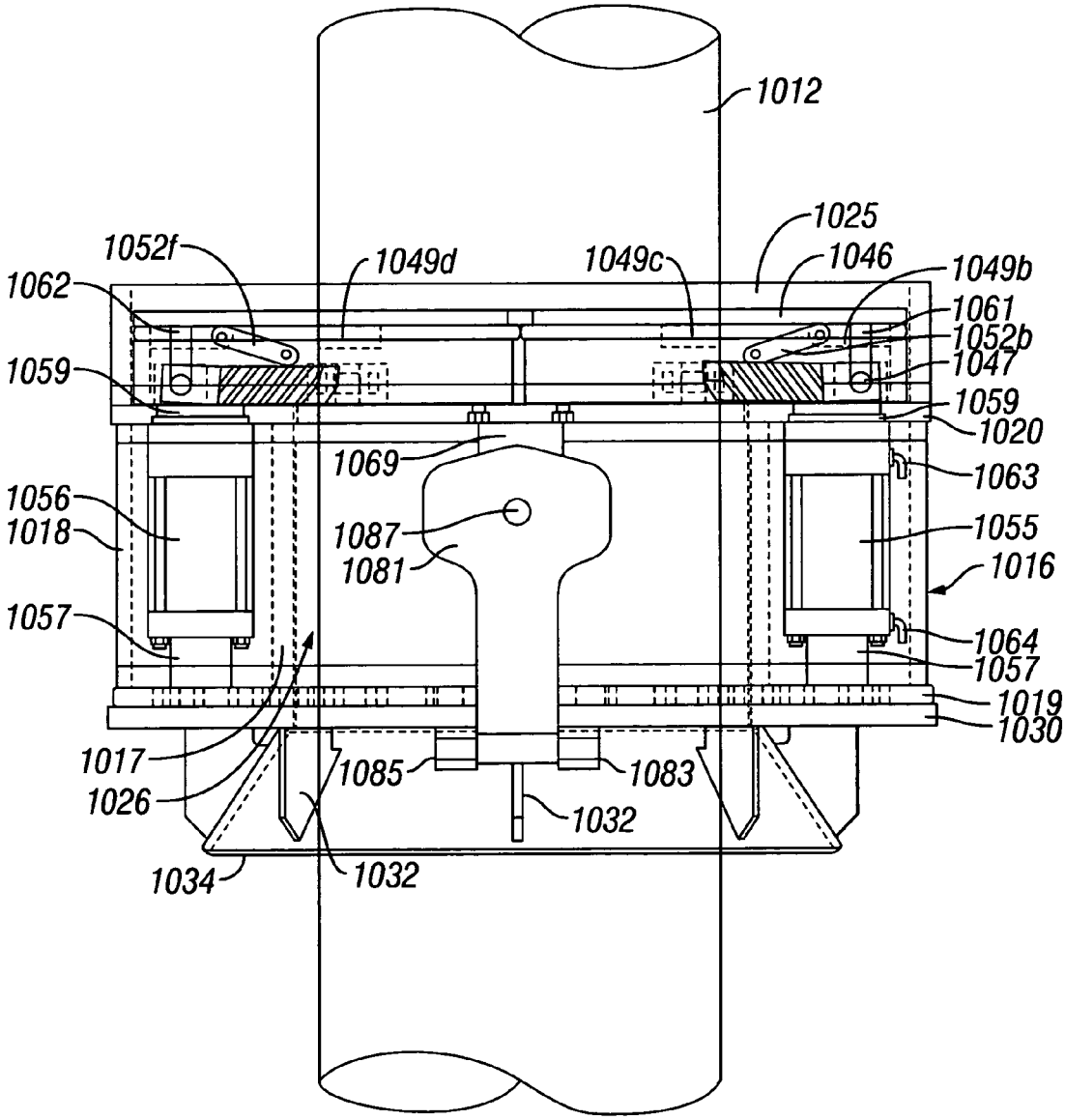
FIG. 15 is another side view of the embodiment of FIG. 15, 90 degrees from the view of FIG. 14.

Referring to FIGS. 13 through 15, an embodiment of the invention is indicated by the reference numeral 1000. Elevator apparatus 1000 is useful for manipulating well bore tubing, in particular, casing, schematically indicated, having a tubular body 1012 terminating in a collar portion (not shown) of larger diameter than casing body 1012. Elevator apparatus comprises an annular body indicated generally by 1016. Body 1016 includes an annular inner panel 1017 and an annular outer panel 1018. Panels 1017 and 1018 are welded at the base of each to an annular base plate 1019 and at the top of each to an annular top plate 1020. Panel 1017 is chamfered at the top, as shown at 1021, and bottom, as shown at 1022, for purposes of welding. Panel 1018 is similarly chamfered, as shown at 1023 and 1024, for welding. Annular base plate 1019 is fastened to an annular bottom plate 1030. Annular inner panel 1017 and annular top and base plates 1020 and 1019 and annular bottom plate

1030 surround body cavity 1026 having a body axis 1028. Annular inner panel 1017, annular top plate 1020, annular base plate 1019 and annular bottom plate 1030 have an identical radius from body axis 1028. The diameter of body cavity 1026 is sufficiently large to allow longitudinal passage of casing 1011, including not only the tubular body portion 1012 but also the collar portion.

Affixed to bottom plate 1030 is an annular frustoconical guidance plate 1034 braced by a plurality of gussets 1032 circumferentially spaced about guidance plate 1034 between it and bottom plate 1025. The base 1031 of guidance plate 1034 is wider than its top 1033, to facilitate centering of casing when elevator apparatus 1000 is lowered onto the collar portion of the casing and thence downwardly about the tubular body 1012 of the casing.

Affixed to the periphery of annular top plate 1020 is an annular sleeve 1025, the bottom of which is chamfered as at 1027 for welding purposes. Within sleeve 1025 a plurality of swivel mounts (1029*a*, 1029*b*, 1029*c*, 1029*e* and 1029*f*) are affixed to annular top plate 1020 spaced circumferentially around the inner diameter of top plate 1020.

Figure 16:
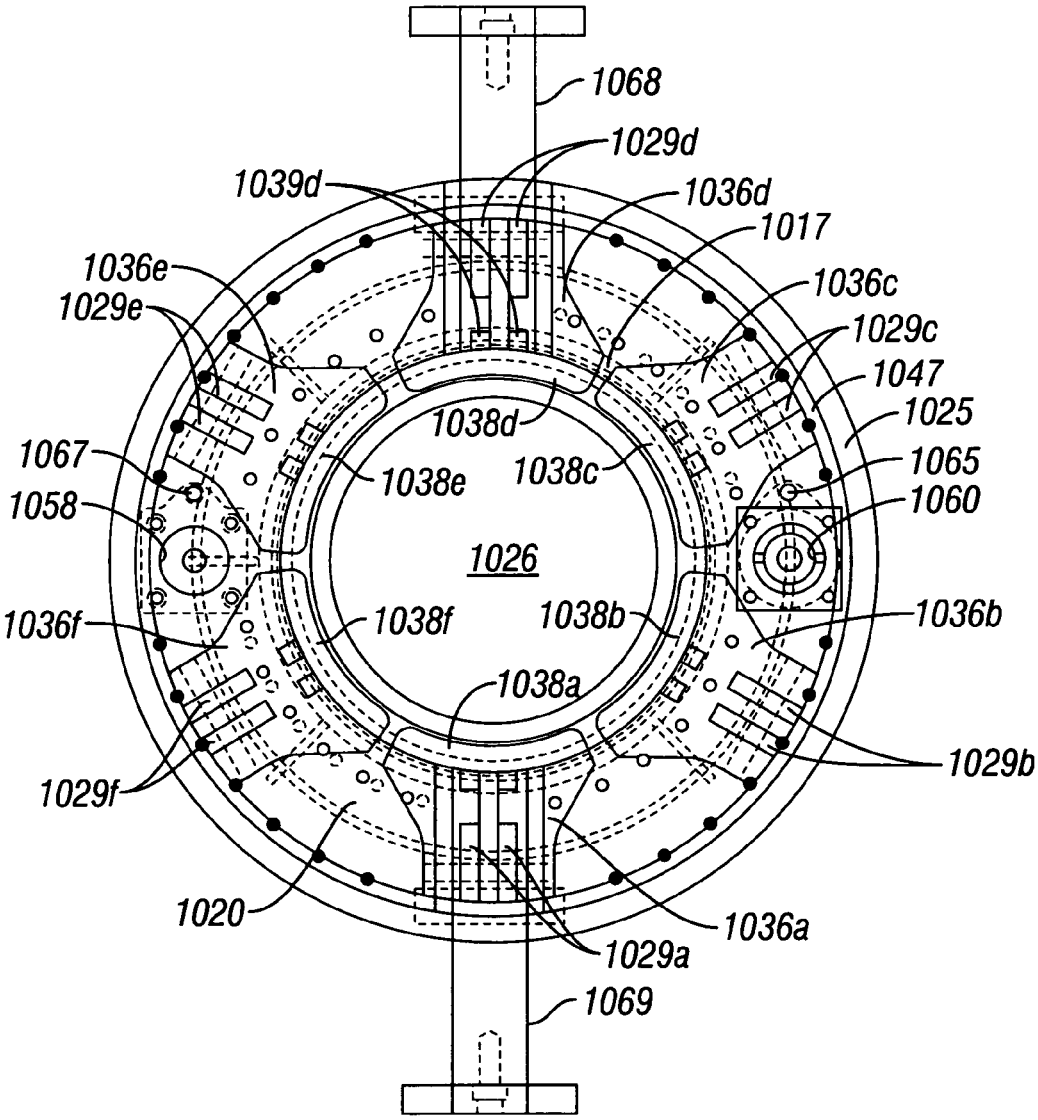
FIG. 16 is a top view of the embodiment seen in FIG. 17.
Figure 17:
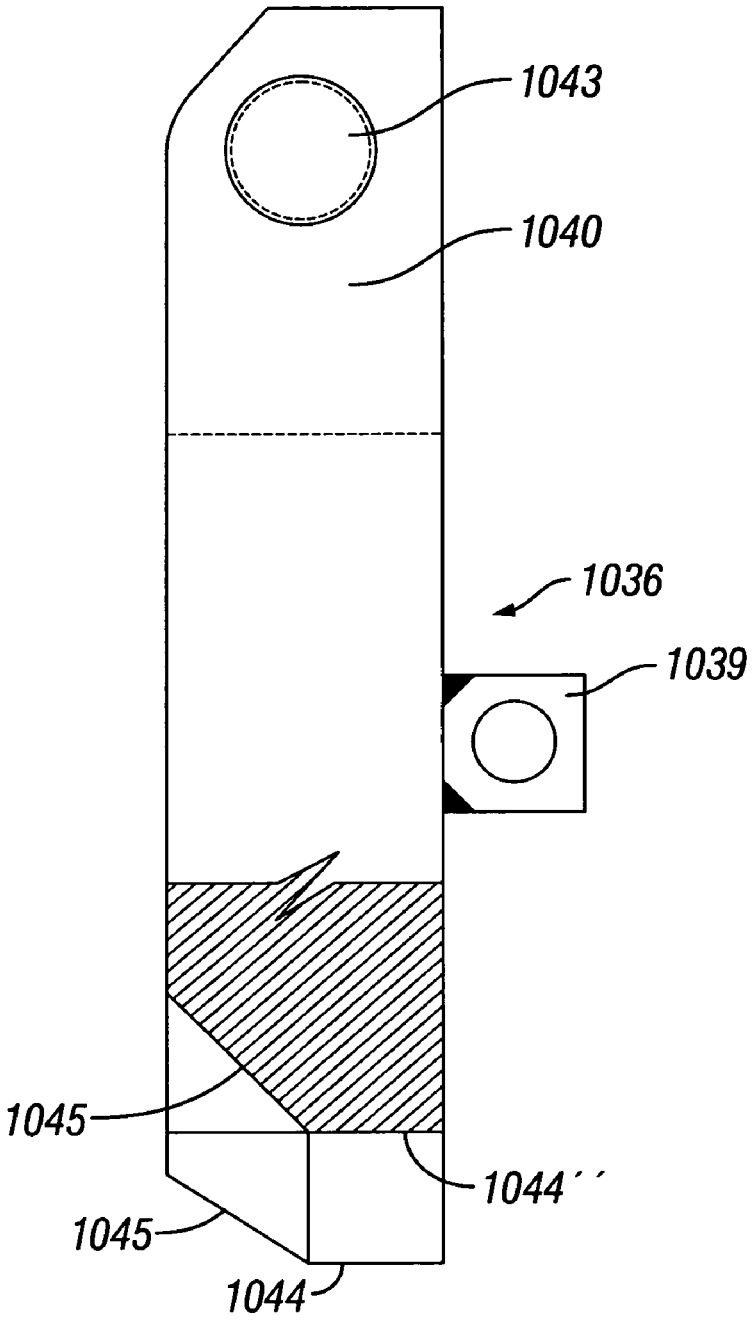
FIG. 17 is a side view of the flap plate used in the embodiment of FIGS. 13–16.
Figure 18:
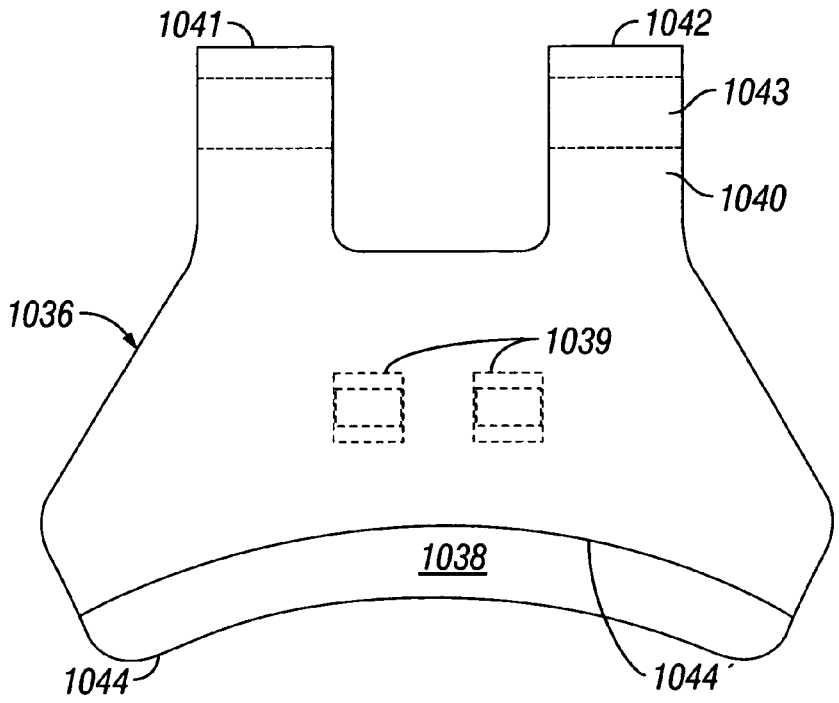
FIG. 18 is a top view of a flap plate of FIG. 17.
Figure 19:
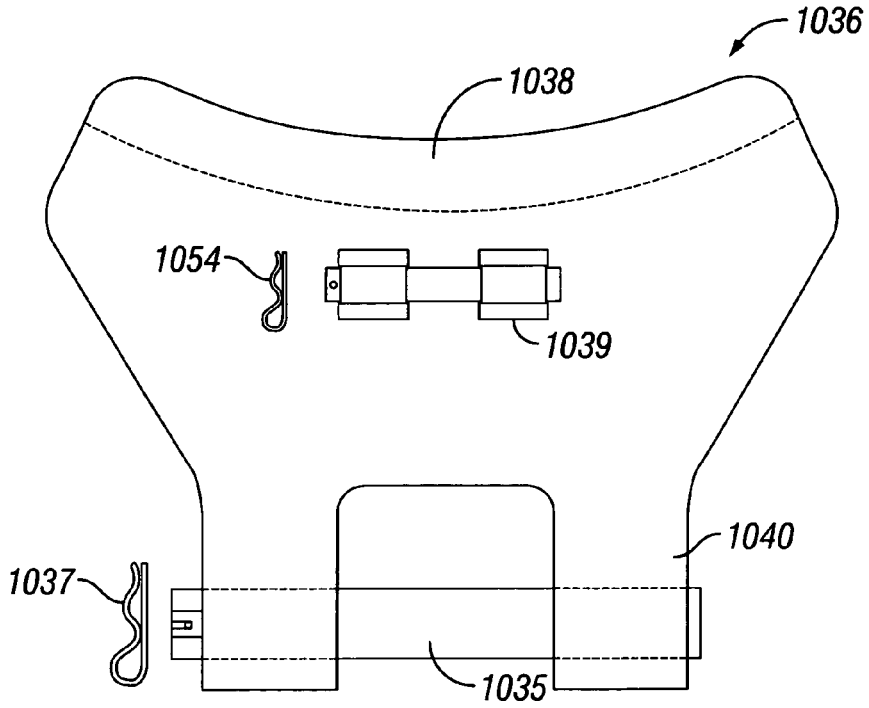
FIG. 19 is a top view of an assembly of the flap plate of FIG. 18.

Referring to FIG. 19, a flap member 1036 (1036*a*, 1036*b*, 1036*c*, 1036*d*, 1036*e*) is fastened by a pin 1035 to a swivel mount 1029. Pin 1035 is secured by a cotter key 1037. As so fastened and as seen in FIGS. 13–16, flap plates 1036 are laterally spaced apart from each other around cavity 1026. Referring to FIGS. 17–19 in conjunction with FIGS. 13–16, flap plate 1036 comprises proximal portions 1038 and distal portions 1040 in relation to cavity 1026 with respect to which it is disposed when mounted on pin 1035 to swivel mounts 1029. Distal portion 1040 includes a yoke 1041, 1042 drilled to provide a passage for pin 1035. Affixed to the top of flap plate 1036 intermediate the distal portion 1040 and the proximal portion 1038 is a swivel mounting pair 1039 drilled to provide a passage 1043. The proximal portion of flap plate 1036 describes arcs 1044, 1044'. Arc 1044' has a longer radius than arc 1044. Arcs 1044, 1044' are beveled on the underside of flap plate 1036 at undercut 1045.

Distal portion 1040 affixed to a swivel mount 1029 by a pin 1035 is pivotally connected to top plate 1020 of body 1016. As depicted in FIGS. 14, 15 and 16 a flap plate 1036 lays on top plate 1020, with proximal portion 1038 extending into cavity 1026. As best seen in FIG. 16, the proximal portion of flap plate 1036*a* extends into cavity 1026, normal to body axis 1028, sufficiently, in combination with other flap plates 1036*b*, 1036*c*, 1036*d*, 1036*f* and 1036*e* so extended, to form a broken circle, comprised of the combination of arcs. The radius of the flap plate arcs 1044*a*–1044*f* and the lengths of such arcs, form a circle having a diameter larger than the external diameter of the tubular body 1012 of the casing but smaller than the external diameter of the collar portion of the casing. Thus with the flap plates extended into cavity 1026, the casing is unable to pass through cavity 1026 of elevator apparatus 1000.

Actuators are provided to lift proximal portions 1038 of flap plates 1036 out of cavity 1026, thereby to allow the collar portion of casing 1011 to pass through cavity 1026 of elevator apparatus 1000. The actuators comprise an annular cap plate 1046, linkages from cap plate 1046 to flap plates 1036*a*–1036*f*, and a cylinder and piston assembly for elevating cap plate 1036 causing the linkages to raise flap plates 1036*a*–1036*f*. More particularly, annular cap plate 1046 has a peripheral skirt 1047 that terminates in a rim 1048, which rests on annular top plate 1020 when flap plates 1036*a*–1036*f* rest on top plate 1020 normal to body axis 1028 with proximal portions 1038*a*–1038*f* extending into cavity 1026. Skirt 1047 is chamfered as at 1048 for welding it to cap plate 1046. A plurality of flange swivel mount pairs 1049*a*–1049*f* equal in number to the number of flap plates 1036*a*–1036*f* is affixed circumferentially spaced around skirt 1047 projecting radially inward and normal to body axis 1028 (in FIG. 16 only the flange swivel plates 1049*a* and 1049*d* are shown, for clear views of the structure relative to flap plates 1036*b*, 1036*c*, 1036*e* and 1036*f*). A pin opening is transversely provided through each swivel mounting pair 1049*a*–1049*f* for receipt of a pin for each opening. A plurality of links 1052*a*–1052*f* equal in number to the number of flap plates 1036*a*–1036*f* receive pins 1051*a*–1051*f* to pivot links 1052*a*–1052*f* from swivel plates 1049*a*–1049*f*. At the opposite end of links 1052*a*–1052*f*, each of the links is provided with another transverse opening for receipt of a pin. This end of links 1052*a*–1052*f* is received between the trunnions of opposed flap plate swivel mounts 1039*a*–1039*f*, and pivotally fastened to swivel mounts 1039*a*–1039*f* by pins 1053*a*–1053*f* respectively, with pins 1053*a*–1053*f* being secured by cotter keys. Thus when cap plate 1046 is elevated, links 1052*a*–1052*f* pivotally lift flap plates 1036*a*–1036*f* off annular top plate 1020, rotating flap plates 1036*a*–1036*f* about the axis of pins in top plate swivel mounts 1029*a*–1029*f*, respectively, to remove the proximal portions 1038*a*–1038*f* of the flap plates out of cavity 1026, as depicted in FIG. 13.

Referring to FIG. 15, a pair of cylinder and piston assemblies 1055, 1056 are disposed in body 1016 between annular base plate 1019 and annular top plate 1020 spaced 180 degrees apart. The base of each cylinder and piston assembly 1055 and 1056 rests on a block 1057 (see also FIG. 22, which shows a like block 1157 in side view in another embodiment of the invention). Block 1057 sits in well 1058 (FIG. 16, see also FIG. 22, which is similar) formed on the upper surface of base plate 1019. The tops of cylinder and piston assemblies 1055 and 1056 are secured by bolts 1059 to the bottom of top plate 1020. Apertures 1060 are provided 180 degrees apart in top plate 1020 centered within bolts 1059 fastening cylinder and piston assemblies 1055 and 1056 to top plate 1020. Received within apertures 1060 are rods 1061, 1062 connected to the pistons of cylinder and piston assemblies 1055, 1056. The rods engagingly reach the underside of annular cap plate 1046 when cap plate skirt 1025 rests on the top of top plate 1020. The rod is moved by force of fluid admitted into or withdrawn from a cylinder within which the piston reciprocates. Fluid, either air for an air cylinder or liquid for a hydraulic cylinder, is circulated above and below the piston in the cylinder admitted through fluid lines 1063, 1064. Openings 1065, 1067 are provided in base plate 1019 and bottom plate 1030 for passage of fluid lines.

Upon movement of the pistons in the cylinders of assemblies 1055, 1056 (upward movement in the orientation of the drawings) the rods 1061 and 1062 connected to the pistons extend upwardly, elevating annular cap plate 1046 parallel to body axis 1028. The elevation of cap plate 1046 pivotally lifts flap plates 1036*a*–1036*f* linked to cap plate 1046 by links 1052*a*–1052*f*. On reverse movement of the pistons in the cylinders of assemblies 1055 and 1056, rods 1061 and 1062 retract, lowering cap plate 1046 and pivotally lowering linked flap plates 1036*a*–1036*f* into cavity 1026. Skirt 1047 of cap plate 1046 is of slightly smaller outer diameter than the inner diameter of sleeve 1025. In the most elevated position of cap plate 1046, the rim of skirt 1047 does not raise above the top of sleeve 1025. This and the close approximation of skirt 1047 within sleeve 1025 shields the flap plates 1036*a*–1036*f* and links 1052*a*–1052*f* are shielded from access by foreign objects, and, as well, fingers or apparel of workers.

Figure 25:
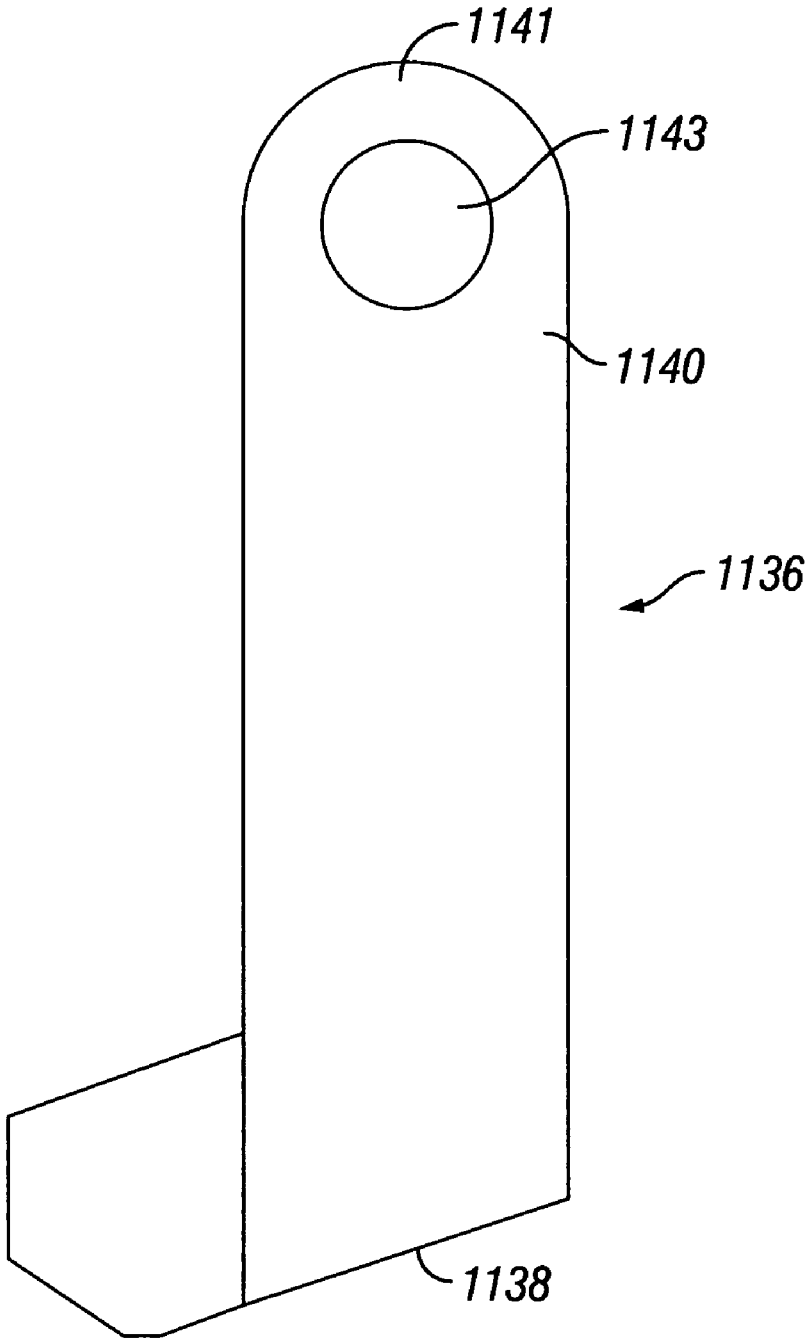
FIG. 25 is a side view of the flap plate of FIG. 24.
Figure 26:
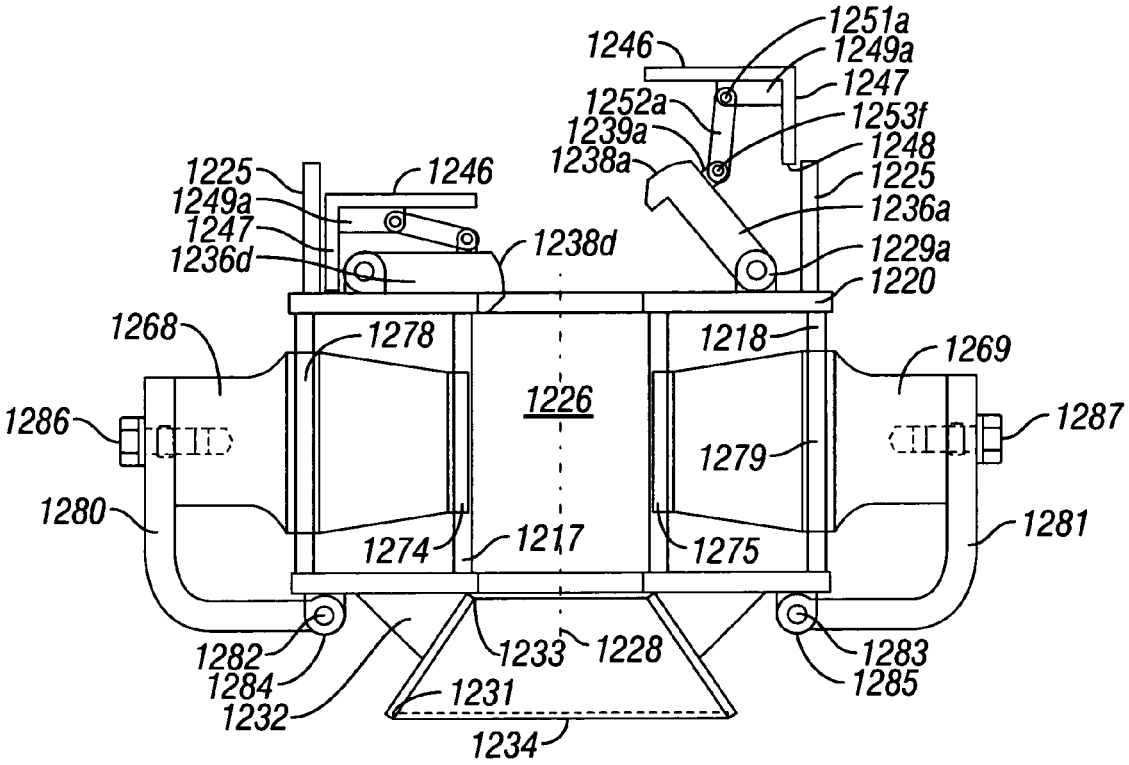
FIG. 26 is a side view of a variation of the embodiment of FIG. 13.
Figure 28:
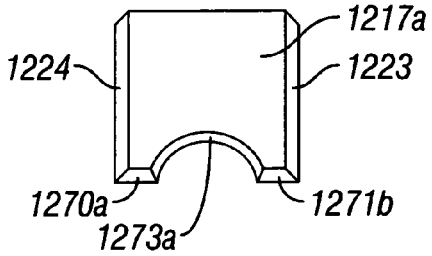
FIG. 28 is a side view of an inner panel portion of the body of the apparatus of FIG. 26.
Figure 29:
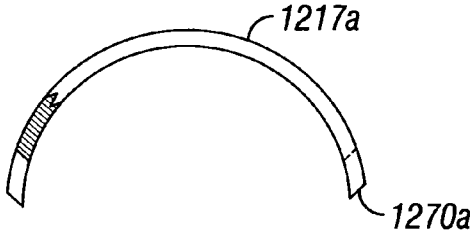
FIG. 29 is a top view of a half inner panel of FIG. 27.

A pair of lift arms 1068, 1069 are secured substantially normal to body 1016, spaced 180 degrees apart and 90 degrees from cylinder and piston assemblies 1055, 1056. Referring to FIGS. 26–31, the manner by which lift arms 1068 and 1069 are secured is described in connection with a variation of the drill pipe elevator apparatus of FIGS. 20–25. The same method of securing lift arms 1068, 1069 is suitably employed for the embodiment of FIGS. 13–19 as for the embodiment of FIGS. 26–31. FIG. 29 is a top view of a half 1217*a* of inner panel 1217 (corresponding to half of inner panel 1017 of FIGS. 13–16). FIG. 28 is a side view of the half 1217*a* of panel 1217. The chamfer 1223 of half panel 1217*a* corresponds to the chamfer 1023 at the top of panel 1017. Chamfer 1224 of half panel 1217*a* corresponds to chamfer 1024 at the bottom of panel 1017. The lateral ends 1270*a* and 1271*a* of half panel 1217*a* are chamfered for welding. Between ends 1270*a* and 1271*a*, half panel 1217*a* is arced at recess 1273*a* in a radius that accepts the outer diameter of a half of lift arms 1268 and 1269 at respective innermost portions 1274, 1275 of the lift arms (FIG. 26). Similarly a mirror image (not depicted) of half panel 1217*a* fits around the other half of the innermost portions 1274, 1275 of respective lift arms 1270, 1271. The recess 1273*a* of the half panel 1217*a* is welded to lift arms 1268, 1269 at innermost portions 1274, 1275, respectively, and the ends of half panel 1217*a* are welded to the corresponding ends 1270*b* and 1271*b* of the half panel. So welded up, the half panels form inner panel 1217.

Figure 30:
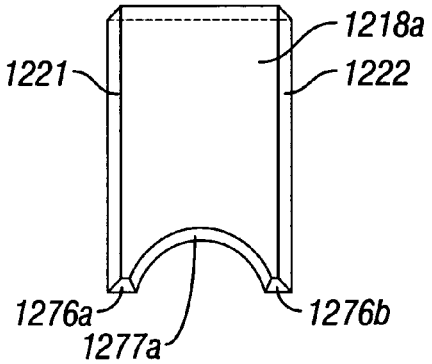
FIG. 30 is a side view of a half outer panel of the body of the apparatus of FIG. 26.
Figure 31:
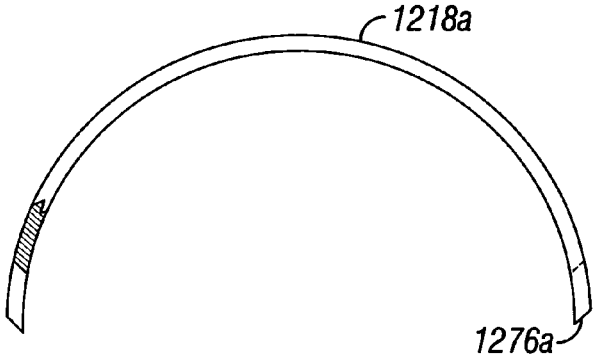
FIG. 31 is a top view of the panel of FIG. 30.

FIG. 31 is a top view of a half 1218*a* of outer panel 1218 (corresponding to half of outer panel 1018 of FIGS. 13–16). FIG. 30 is a side view of the half 1218*a* of panel 1218. The chamfer 1222 of half panel 1218*a* corresponds to the chamfer 1022 at the top of panel 1018. Chamfer 1221 of half panel 1218*a* corresponds to chamfer 1021 at the bottom of panel 1018. The lateral ends 1276*a* and 1277*a* of half panel 1218*a* are chamfered for welding. Between ends 1276*a* and 1277*a*, half panel 1218*a* is arced at recess 1277*a* in a radius that accepts the outer diameter of a half of lift arms 1268 and 1269 at respective intermediate portions 1278, 1279 of the lift arms (FIG. 26). Similarly a mirror image (not depicted) of half panel 1218*a* fits around the other half of the intermediate portions 1278, 1279 of respective lift arms 1270, 1271. The recesses 1277*a* and 1277*b* of the two half panels 1218*a* and 1218*b* are welded to lift arms 1268, 1269 at intermediate portions 1278, 1279, respectively, and the ends 1276*a* and 1277*a* of half panel 1218*a* are welded to the corresponding ends of the half panel. So welded up, the half panels form outer panel 1218.

Keeps 1080, 1081 respectively for lift arms 1068, 1069 are hingedly mounted to body 1016 by pins 1082, 1083 fitted into mounts 1084, 1085, respectively. Mounts 1084, 1085 are affixed to the underside of bottom plate 1030. Keeps 1080, 1081 are fastened to lift arms 1068, 1069, respectively, by bolts 1086, 1087 threadedly received in tapped openings in the ends of lifts arms 1068, 1069. The bales 1090 of draw works of a rig over the well bore are received under the lift arms between the lift arms and the keeps.

Figure 20:
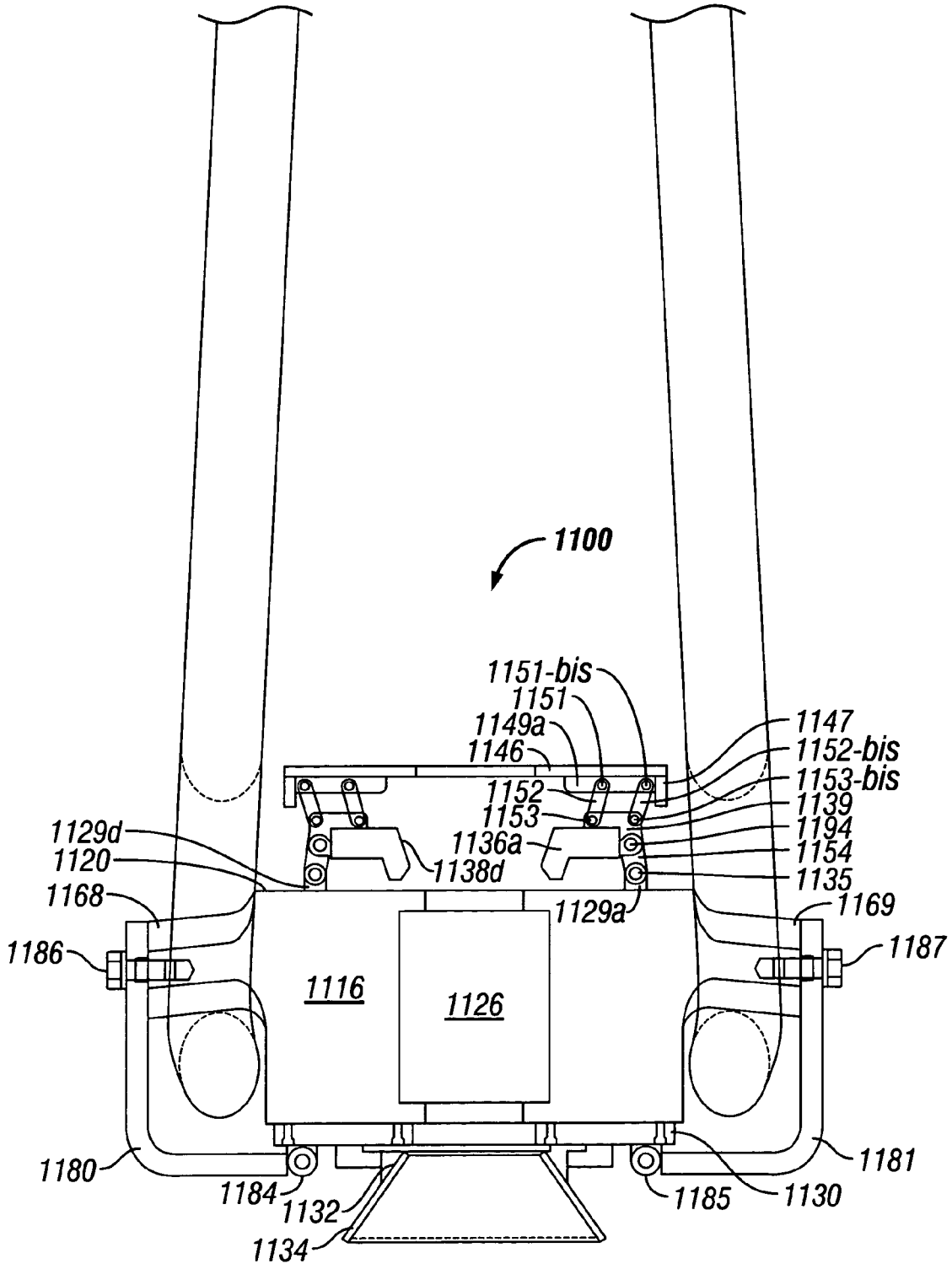
FIG. 20 is a side view of another embodiment of Basic Form III of this invention, useful for manipulating drill pipe, showing flap plates in elevated position, and also depicting bails used for raising and lowering the apparatus.
Figure 21:
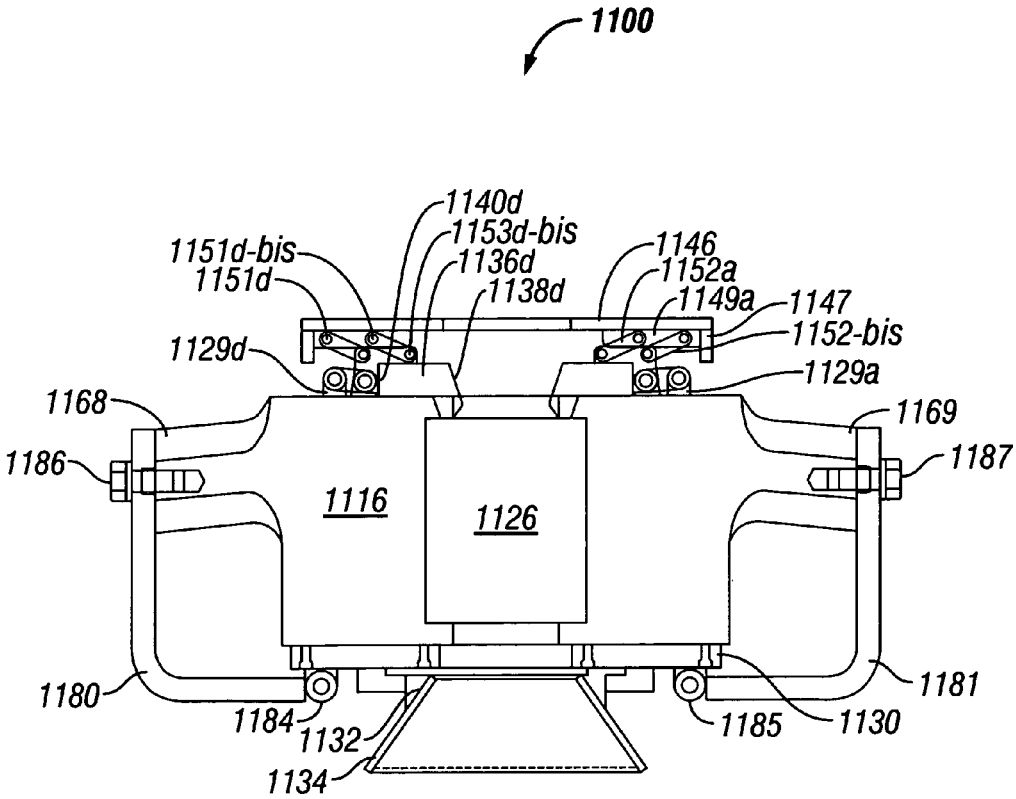
FIG. 21 is another side view of the embodiment of FIG. 20, showing the flap plates in lowered position.
Figure 22:
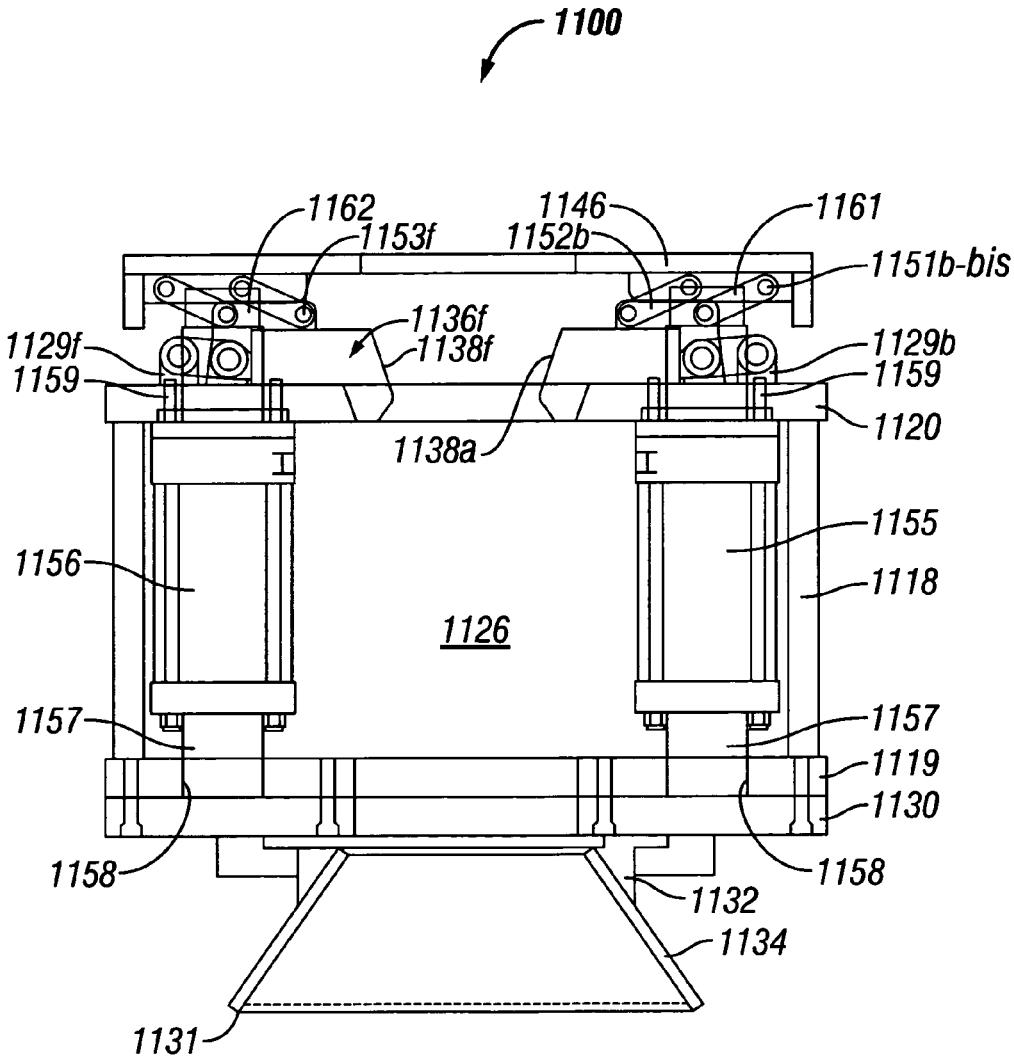
FIG. 22 is a sectional side view of the embodiment of FIG. 20, viewed 90 degrees from the view of FIG. 21, with portions of the apparatus removed for in side interior view showing the cylinder and piston assemblies of the embodiment.
Figure 23:
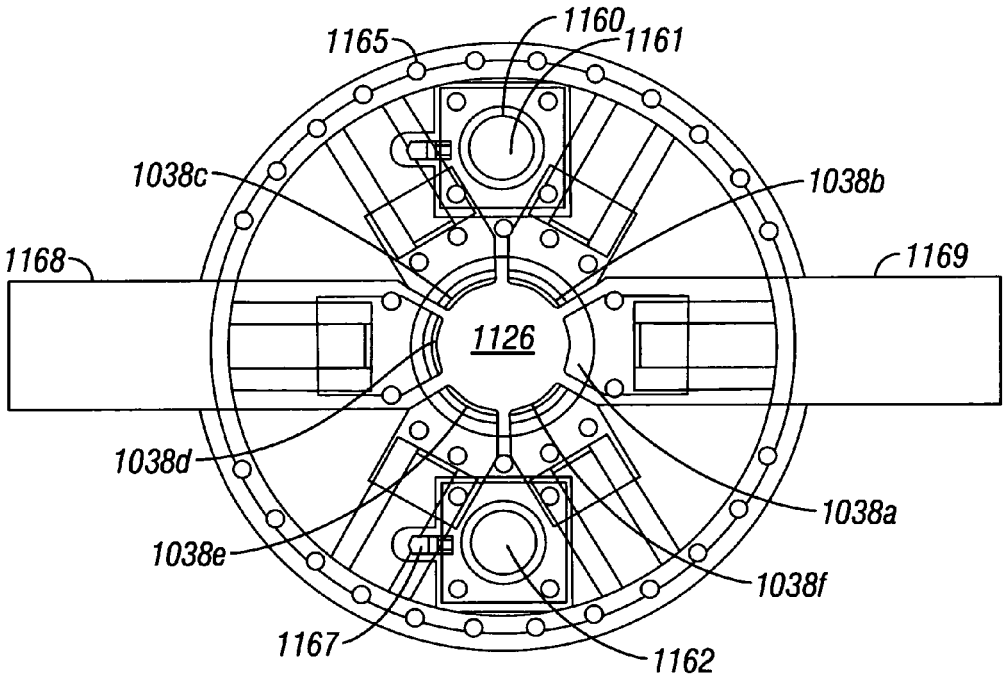
FIG. 23 is a top view of the apparatus of FIG. 20.

Referring now to FIGS. 20 through 22, another embodiment of the invention is indicated by the reference numeral 1100. Elevator apparatus 1100 is useful for manipulating well bore tubing of smaller diameter than casing, in particular, drill pipe (not depicted) having a tubular body terminating in a collar portion of larger diameter than the drill pipe, particularly where the tubing body transitions in an "upset" to the collar. Elevator apparatus comprises an annular body indicated generally by 1116. As best viewed in FIG. 22, body 1116 includes an annular panel 1118. Panel 1118 is welded at the base to an annular base plate 1119 and at the top to an annular top plate 1120. Annular base plate 1119 is fastened to an annular bottom plate 1130. Annular panel 1118 and annular top and base plates 1120 and 1119 and annular bottom plate 1130 surround body cavity 1126 having a body axis 1128. The diameter of body cavity 1126 is sufficiently large to allow longitudinal passage of drill pipe including not only the tubular body portion but also the collar portion.

Affixed to bottom plate 1130 is an annular frustoconical guidance plate 1134 braced by a plurality of gussets 1132 circumferentially spaced about guidance plate 1134 between it and bottom plate 1130. The base 1131 of guidance plate 1134 is wider than its top 1133, to faciliate centering of drill pipe when elevator apparatus 1100 is lowered onto the collar portion of the drill pipe and thence downwardly about the tubular body of the drill pipe.

A plurality of swivel mounts 1129 (1129*a*, 1129*b*, 1129*c*, 1129*e* and 1129*f*) are affixed to annular top plate 1120 spaced circumferentially around the inner diameter of top plate 1120.

Figure 24:
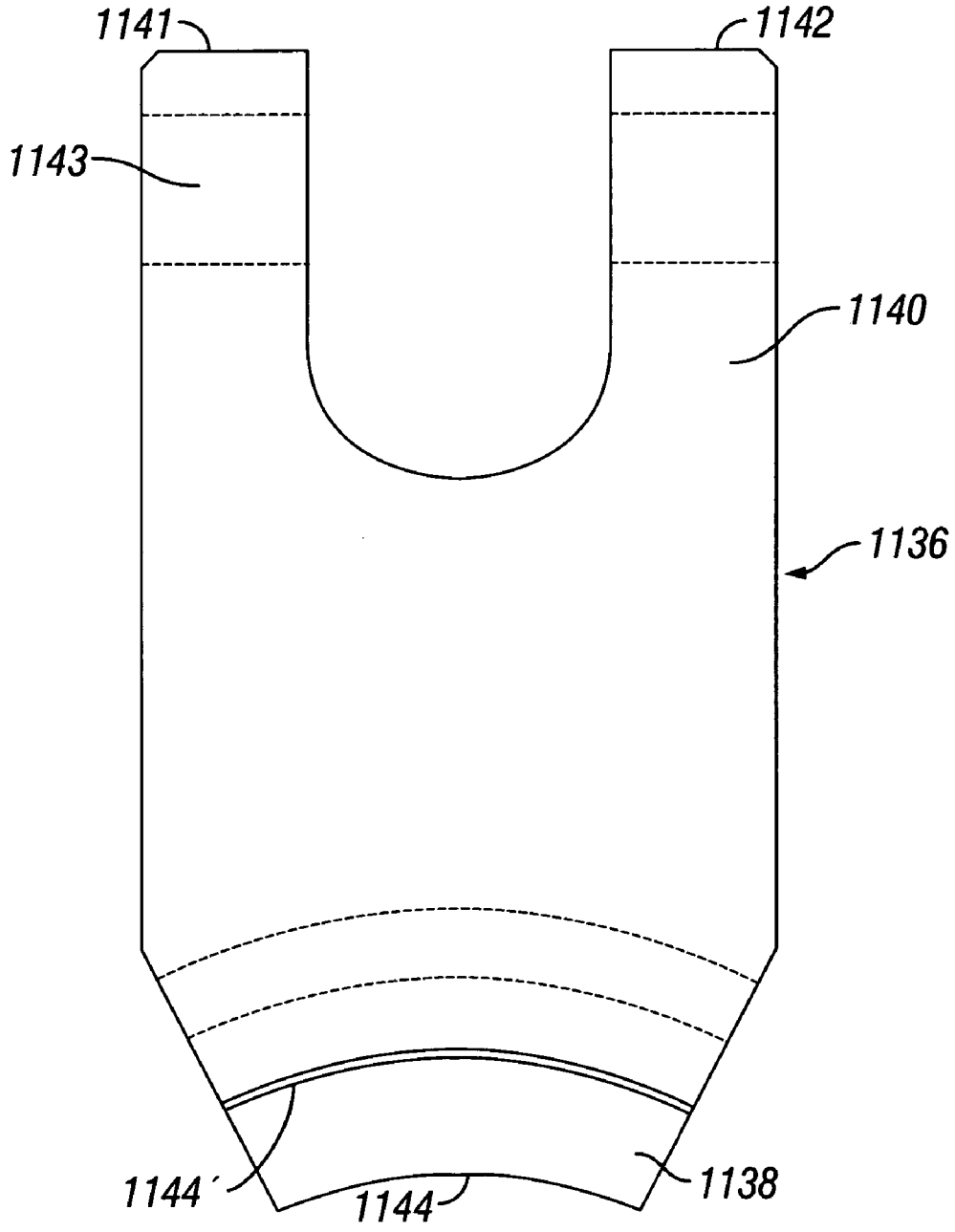
FIG. 24 is a top view of a flap plate of the type useful in the embodiment of FIG. 20.

A flap member 1136 (1136*a*, 1136*b*, 1136*c*, 1136*d*, 1136*e*) is fastened by a pin 1135 to a swivel mount 1129. As so fastened and as seen in FIGS. 8–10, flap plates 1136 are laterally spaced apart from each other around cavity 1126. Referring to FIGS. 24 and 25 in conjunction with FIGS. 20–23, flap plate 1136 comprises proximal portions 1138 and distal portions 1140 in relation to cavity 1126 with respect to which it is disposed when mounted on pin 1135 to swivel mounts 1129. Distal portion 1140 includes a yoke 1141, 1142 drilled to provide a passage 1143 for pin 1135. The proximal portion of flap plate 1136 of flap 1136 angles downwardly from the distal portion, at an acute angle of 45 degrees, and describes arc 1144, 1144', arc 1144' having a longr radius than arc 1144.

Distal portion 1140 is pivotally connected to top plate 1120 of body 1116. As depicted in FIGS. 8, 9 and 10, a flap plate 1136 lays on top plate 1120, with proximal portion 1138 extending into cavity 1126. As advantageously seen with FIG. 23 in combination with FIGS. 21 and 22, the proximal portion of flap plates 1136*a* extends into cavity 1126, normal to body axis 1128, sufficiently, in combination with other flap plates 1136*b*, 1136*c*, 1136*d*, 1136*f* and 1136*e* so extended, to form a broken circle, comprised of the combination of arcs 1144*a*, 1144*b*, 1144*c*, 1144*d*, 1144*e* and 1144*f*. The radius of flap plate arcs 1144*a*–1144*f* and the lengths of such arcs, form a circle having a diameter larger than the external diameter of the tubular body of a drill pipe but smaller than the external diameter of the collar portion of the drill pipe. Thus with the flap plates extended into cavity 1126, drill pipe is unable to pass through cavity 1126 of elevator apparatus 1100.

Actuators are provided to lift proximal portions 1138 of flap plates 1136 out of cavity 1126, thereby to allow the collar portion of a drill pipe to pass through cavity 1126 of elevator apparatus 1100. The actuators comprise an annular cap plate 1146, linkages from cap plate 1146 to flap plates 1136*a*–1136*f*, and a cylinder and piston assembly for elevating cap plate 1136 causing the linkages to raise flap plates 1136*a*–1136*f*. More particularly, annular cap plate 1146 has a peripheral skirt 1147 that terminates in a rim 1148, which rests on annular top plate 1120 when flap plates 1136*a*–1136*f* rest on top plate 1120 normal to body axis 1128 with proximal portions 1138*a*–1138*f* extending into cavity 1126.

A plurality of flange swivel mount pairs 1149*a*–1149*f* equal in number to the number of flap plates 1136*a*–1136*f* is affixed circumferentially spaced around skirt 1147 projecting radially inward and normal to body axis 1128 (only flange swivels 1149*a* and 1149*d* are shown). Each of flange swivel mount pairs 1149*a*–1149*f* has pivotally connected to it a pair of links 1152 and 1152-bis. A pin 1151 received in an opening transversely formed in link 1152 and secured in trunnions of a flange swivel mount pair provides the pivotal connection for link 1152. Similarly, a pin 1151-bis received in an opening transversely formed in link 1152-bis and secured in trunnions of the same flange swivel mount pair provides the pivotal connection for link 1152-bis. At the other end of links 1152 and 1152-bis, links 1152 and 1152-bis are pivotally connected to the top portion of a flap plate flange 1139. Flap plate flange 1139 is affixed to the top of flap plate 1136 distal to proximal portion 1138, and is also affixed to the rear of distal portion 1040. A pin 1153 received in an opening transversely formed in link 1152 at such other end is secured in mounts of flap plate flange 1139 to provide the pivotal connection of link 1152 to the portion of flap plate flange 1139 at the top of flap plate 1136. Similarly a pin 1153-bis received in an opening transversely formed in link 1152-bis at such other end is secured in mounts of flap plate flange 1139 to provide the pivotal connection of link 1152-bis to the portion of flap plate flange 1139 at the top of flap plate 1136.

The portion of flap plate flange 1138 affixed to the rear of flap plate 1136 is pivotally connected by link 1154 to swivel mount 1129 affixed to annular top plate 1120 within the perimeter of skirt 1147 when it rests on annular top plate 1120. A pin 1194 received in an opening transversely formed in the rear portion of flap plate flange 1138 is pivotally secured in link 1154, and a pin 1195 received on an opening at the opposite end of link 1154 is pivotally received in swivel mount 1129 to provide the pivotal connection of the portion of flap plate flange 1139 at the rear of flap plate 1136 to swivel mount 1129.

The linkage of flap plate 1136 to annular top plate 1120 and cap plate 1146 as just described occurs for each of flap plates 1136*a*–1136*f*. Thus when cap plate 1146 is elevated, links 1152*a* and 1152*a*-bis, 152*b* and 1152*b*-bis, 1152*c* and 1152*c*-bis, 1152*d* and 1152*d*-bis, 1152*e* and 1152*e*-bis and 1152*f* and 1152*f*-bis, respectively pivotally lift flap plate flanges 1139*a*, 1139*b*, 1139*c*, 1139*d*, 1139*e*, and 1139*f*, which respectively pivot links 1154*a*, 1154*b*, 1154*c*, 1154*d*, 1154*e* and 1154*f*, upward on mounts 1129*a*, 1129*b*, 1129*c*, 1129*d*, 1129*e* and 1129*f*, respectively. This combined action lifts the proximal portion of flap plates 1136*a*, 1136*b*, 1136*c*, 1136*d*, 1136*e* and 1136*f* out of cavity 1126 and not only the proximal portion 10038 but also the distal portion 1040 of each flap plate off annular top plate 1120.

Referring to FIG. 15, a pair of cylinder and piston assemblies 1155, 1156 are disposed in body 1116 between annular base plate 1119 and annular top plate 1120 spaced 180 degrees apart. The base of each cylinder and piston assembly 1155 and 1156 rests on a block 1157 (FIG. 22). Block 1157 sits in well 1158 formed on the upper surface of base plate 1119. The tops of cylinder and piston assemblies 1155 and 1156 are secured by bolts 1159 to the bottom of top plate 1120. Apertures 1160 are provided 180 degrees apart in top plate 1120 centered within bolts 1159 fastening cylinder and piston assemblies 1155 and 1156 to top plate 1120. Received within apertures 1160 are rods 1161, 1162 connected to the pistons of cylinder and piston assemblies 1155, 1156. The rods engagingly reach the underside of annular cap plate 1146 when cap plate skirt 1125 rests on the top of top plate 1120. The rod is moved by force of fluid admitted into or withdrawn from a cylinder within which the piston reciprocates. Fluid, either air for an air cylinder or liquid for a hydraulic cylinder, is circulated above and below the piston in the cylinder admitted through fluid lines 1163, 1164. Openings 1165, 1167 are provided in base plate 1119 and bottom plate 1130 for passage of fluid lines 1163*a*, 1164*a* (through 1165) and 1163*b*, 1164*b* (through 1167).

Upon movement of the pistons in the cylinders of assemblies 1155, 1156 (upward movement in the orientation of the drawings) the rods 1161 and 1162 connected to the pistons extend upwardly, elevating annular cap plate 1146 parallel to body axis 1128. The elevation of cap plate 1146 pivotally lifts flap plates 1136*a*–1136*f* linked to cap plate 1146 by flanges 1149, links 1152 and 1152-bis, flap plate flanges 1139 and links 1154, as has been described. On reverse movement of the pistons in the cylinders of assemblies 1155 and 1156, rods 1161 and 1162 retract, lowering cap plate 1146 and pivotally lowering linked flap plates 1136*a*–1136*f* into cavity 1126.

A pair of lift arms 1168, 1169 are secured substantially normal to body 1116, 180 degrees apart, spaced 90 degrees from cylinder and piston assemblies 1155, 1156. The manner of securing lift arms 1168 and 1169 as described above may be used as well for securing the lift arms of the embodiment described in connection with FIGS. 1–13.

Keeps 1180, 1181 respectively for lift arms 1168, 1169 are hingedly mounted to body 1116 by pins 1182, 1183 fitted into mounts 1184, 1185, respectively. Mounts 1184, 1185 are affixed to the underside of bottom plate 1130. Keeps 1180, 1181 are fastened to lift arms 1168, 1169, respectively, by bolts 1186, 1187 threadedly received in tapped openings in the ends of lifts arms 1168, 1169. The bales 1190 of draw works of a rig over the well bore are received under the lift arms between the lift arms and the keeps.

Figure 27:
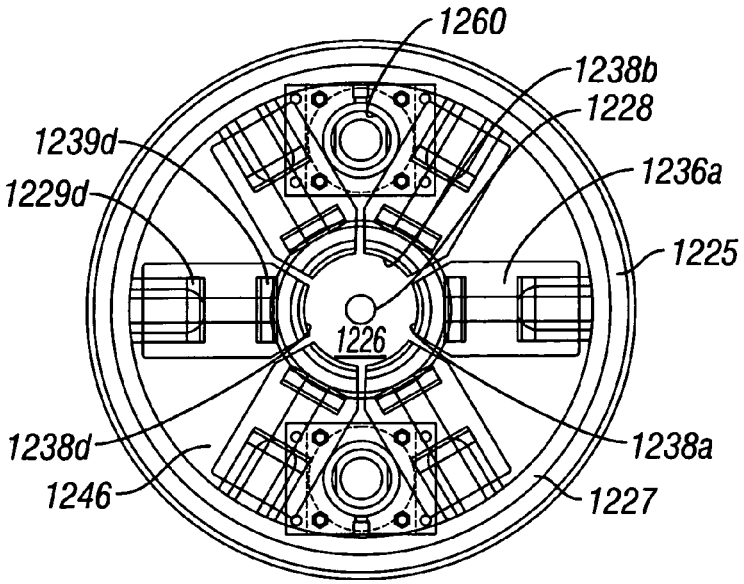
FIG. 27 is a top view of the apparatus of FIG. 26.

Referring now to FIGS. 26 and 27, a variation of the foregoing embodiments is schematically depicted, combining the flap plate elevation apparatus of FIGS. 13– 19 with the flap plate structure of FIGS. 20–25. FIGS. 28–31 have already been described in connection with the manner of securing lift arms to the body of the elevator apparatus. With familiarity gained by the description of FIGS. 13–16, it suffices to describe the embodiment of FIG. 26 to point out that an embodiment of the invention is indicated by the reference numeral 1200. Elevator apparatus comprises an annular body indicated generally by 1216. Body 1216 includes an annular inner panel 1217 and an annular outer panel 1218. Panels 1217 and 1218 are welded at the base of each to an annular base plate 1219 and at the top of each to an annular top plate 1220. Annular base plate 1219 is fastened to an annular bottom plate 1230. Annular inner panel 1217 and annular top and base plates 1220 and 1219 and annular bottom plate 1230 surround body cavity 1226 having a body axis 1228. The diameter of body cavity 1226 is sufficiently large to allow longitudinal passage of casing 1211, including not only the tubular body portion 1212 but also the collar portion.

Affixed to bottom plate 1230 is an annular frustoconical guidance plate 1234 braced by a plurality of gussets 1232 circumferentially spaced about guidance plate 1234. The base 1231 of guidance plate 1234 is wider than its top 1233, to facilitate centering of casing 1211 when elevator apparatus 1200 is lowered onto the collar portion of the casing and thence downwardly about the tubular body 1212 of casing 1211.

Affixed to the periphery of annular top plate 1220 is an annular sleeve 1225. Within sleeve 1225 a plurality of swivel mounts 1229 (1229*a*, 1229*b*, 1229*c*, 1229*e* and 1229*f*) are affixed to annular top plate 1220 spaced circumferentially around the inner diameter of top plate 1220. Only swivel mounts 1229*b* and 1229*f* are viewed in FIG. 28.

A flap plate 1236 (1236*a*, 1236*b*, 1236*c*, 1236*d*, 1236*e*) is fastened by a pin 1235 to a swivel mount 1229. As so fastened, flap plates 1236 are laterally spaced apart from each other around cavity 1226. Flap plate 1236 comprises proximal portions 1238 and distal portions 1240 in relation to cavity 1226 with respect to which it is disposed when mounted on pin 1235 to swivel mounts 1229. Affixed to the top of flap plate 1236 intermediate the distal portion 1240 and the proximal portion 1238 is a swivel mounting pair 1239 drilled to provide a passage 1243. The proximal portion of flap plate 1236 describes arc 1244, 1244' as for flap plate 1136, and is structured similarly to flap plate 1136.

Distal portion 1240 affixed to a swivel mount 1229 by a pin 1235 is pivotally connected to top plate 1220 of body 1216. Flap plate 1236 lays on top plate 1220, with proximal portion 1238 extending into cavity 1226. The proximal portion of flap plate 1236*a* extends into cavity 1226, normal to body axis 1228, sufficiently, in combination with other flap plates 1236*b*, 1236*c*, 1236*d*, 1236*f* and 1236*e* so extended, to form a broken circle, comprised of the combination of arcs 1244*a*, 1244*b*, 1244*c*, 1244*d*, 1244*e* and 1244*f*. The radii of flap plate arcs 1244*a*, 1244'*a*–1244*f*, 1244'*f* and the lengths of such arcs, form a circle having a diameter larger than the external diameter of the tubular body 1212 of a drill pipe but smaller than the external diameter of the collar portion of the drill pipe. Thus with the flap plates extended into cavity 1226, the tubular body portion but not the collar portion of the drill pipe is able to pass through cavity 1226 of elevator apparatus 1200, thus holding the drill pipe in the elevator apparatus.

Actuators are provided to lift proximal portions 1238 of flap plates 1236 out of cavity 1226, thereby to allow the collar portion of casing 1211 to pass through cavity 1226 of elevator apparatus 1200. The actuators comprise an annular cap plate 1246, linkages from cap plate 1246 to flap plates 1236*a*–1236*f*, and a cylinder and piston assembly for elevating cap plate 1236 causing the linkages to raise flap plates 1236*a*–1236*f*. More particularly, annular cap plate 1246 has a peripheral skirt 1247 that terminates in a rim 1248, which rests on annular top plate 1220 when flap plates 1236*a*–1236*f* rest on top plate 1220 normal to body axis 1228 with proximal portions 1238*a*–1238*f* extending into cavity 1226. A plurality of flange swivel mount pairs 1249*a*–1249*f* equal in number to the number of flap plates 1236*a*–1236*f* is affixed circumferentially spaced around skirt 1247 projecting radially inward and normal to body axis 1228 (in FIG. 26 only the flange swivel plates 1249*b* and 1249*f* are viewable). A pin opening 1250 is transversely provided through each swivel mounting pair 1249*a*–1249*f* for receipt of a pin 1251 for each opening. A plurality of links 1252*a*–1252*f* equal in number to the number of flap plates 1236*a*–1236*f* receive pins 1251*a*–1251*f* to pivot links 1252*a*–1252*f* from swivel plates 1249*a*–1249*f*. At the opposite end of links 1252*a*–1252*f*, each of the links is provided with another transverse opening for receipt of a pin 12. This end of links 1252*a*–1252*f* is received between the trunnions of opposed flap plate swivel mounts 1239*a*–1239*f*, and pivotally fastened to swivel mounts 1239*a*–1239*f* by pins 1253*a*–1253*f* respectively. Thus when cap plate 1246 is elevated, links 1252*a*–1252*f* pivotally lift flap plates 1236*a*–1236*f* off annular top plate 1220, rotating flap plates 1236*a*–1236*f* about the axis of pins 1235*a*–1235*f* in stop plate swivel mounts 1229*a*–1229*f*, respectively, to remove the proximal portions 1238*a*–1238*f* of the flap plates out of cavity 1226, as depicted on the right side of FIG. 26.

As in the embodiments of FIGS. 13–25, a pair of cylinder and piston assemblies raise and lower annular top plate 1220. The arrangement of the cylinder and piston assemblies is the same as in FIGS. 13–25. Upon movement of the pistons in the cylinders of assemblies (upward movement in the orientation of the drawings) rods connected to the pistons extend upwardly, elevating annular cap plate 1246 parallel to body axis 1228. The elevation of cap plate 1246 pivotally lifts flap plates 1236*a*–1236*f* linked to cap plate 1246 by links 1252*a*–1252*f*. On reverse movement of the pistons in the cylinders of assemblies, the rods retract, lowering cap plate 1246 and pivotally lowering linked flap plates 1236*a*–1236*f* into cavity 1226. Skirt 1247 of cap plate 1246 is of slightly smaller outer diameter than the inner diameter of sleeve 1225. In the most elevated position of cap plate 1246, the rim of skirt 1247 does not raise above the top of sleeve 1225. This and the close approximation of skirt 1247 within sleeve 1225 shields the flap plates 1236*a*–1236*f* and links 1252*a*–1252*f* are shielded from access by foreign objects, and, as well, fingers or apparel of workers.

A pair of lift arms 1268, 1269 are secured substantially normal to body 1216, 180 degrees apart, spaced 90 degrees from cylinder and piston assemblies 1255, 1256. The manner of securing lift arms 1268 and 1269 as described above may be used as well for securing the lift arms of the embodiment described in connection with FIGS. 13–25.

Keeps 1280, 1281 respectively for lift arms 1268, 1269 are hingedly mounted to body 1216 by pins 1282, 1283 fitted into mounts 1284, 1285, respectively. Mounts 1284, 1285 are affixed to the underside of bottom plate 1230. Keeps 1280, 1281 are fastened to lift arms 1268, 1269, respectively, by bolts 1286, 1287 threadedly received in tapped openings in the ends of lifts arms 1268, 1269. The bales 1290 of draw works of a rig over the well bore are received under the lift arms between the lift arms and the keeps.

It will be appreciated that the type of action described for the linkage used in the embodiment of FIGS. 13–19 and 26–31 and the type of action described for the linkages of FIGS. 20–25 both lift the proximal portions of the flap plates out of the cavity of the body of the elevator apparatus, the apparatus of FIGS. 13–19 and 26–31 swing the proximal portion of the flap plates upwardly along a rotational axis fixed atop the annular top plate of the body, whereas the apparatus of FIGS. 20–25 lift the proximal portion and well as the distal portion off the top plate of the body, pivoting the proximal portion out of the body cavity radially away from a projection of the cavity. Both types of movements lifting and lowering the proximal portions of the flap plates are comprehended by the expressions found in this specification wherein the distal portion of a flap plate is described as pivotally secured to the body top for pivoted elevation of the proximal end off the body top, and wherein the proximal portions of flap plates are described as being pivotally lifted out of or lowered into said cavity.

While the invention has been described with respect to basic forms of the invention, it will be understood by those skilled in the art that the invention is not to be limited in any manner by the specifics that have been set forth to illustrate how the principles of the invention can be specifically applied. All alternatives and modifications of the foregoing are intended to be covered within the scope of the appended claims.

We claim:

1. An elevator apparatus for manipulating well bore tubing having a collar, comprising:

a circular body having a top and a central cavity around a body axis, the cavity having a diameter allowing the collar portion of tubing to pass longitudinally therethrough, a plurality of petal plates having radially inner and outer portions, horizontally supported on and spaced apart around the top of the body, and one or more actuators operatively associated with the petal plates, for moving each petal plate radially inward, substantially normal to the body axis, over the body, into the cavity, an extent sufficient, in combination with the other petal plates so extended, to prevent passage of the collar portion of the tubing through the cavity, thereby to hold the tubing with the elevator, in which said body is a fulcrum for the petal plates when they are extended into the cavity and hang tubing within the elevator, and wherein the elevator apparatus further comprises a counterforce member in operative arrangement with the petal plates for opposing leverage imparted over said fulcrum to the portion of the petal plates radially outward from said body, wherein the counterforce member is a circular member surrounding the cavity, spaced radially outward from the body and at least partially located above and adjacent the outer portion of the petal plates at least when they are extended into the cavity.

2. The elevator apparatus of claim 1 in which said circular member is secured by one or more buttresses fixed relative to the body below the petal plates.

3. The elevator apparatus of claim 2 in which a plurality of buttresses are interposed between the spaced apart petal plates.

4. The elevator apparatus of claim 1 in which said one or more actuators also operate to retract the proximal portions of the petal plates radially out of the cavity, to allow the collar portion of the tubing to pass through the cavity.

5. The elevator apparatus of claim 4 in which the actuator comprises a cam and the petal plate is a cam follower.

6. The elevator apparatus of claim 5 in which the cam is received in an aperture in the petal plate between the inner and outer portions of the petal plate.

* * * * *